US011045055B2

(12) United States Patent
Asahi et al.

(10) Patent No.: US 11,045,055 B2
(45) Date of Patent: Jun. 29, 2021

(54) CLEANING TOOL AND VACUUM CLEANER

(71) Applicant: Mitsubishi Electric Corporation, Tokyo (JP)

(72) Inventors: Yohei Asahi, Tokyo (JP); Koshiro Takano, Tokyo (JP); Marika Haramaki, Tokyo (JP); Kimiyoshi Soma, Saitama (JP)

(73) Assignee: Mitsubishi Electric Corporation, Tokyo (JP)

( * ) Notice: Subject to any disclaimer, the term of this patent is extended or adjusted under 35 U.S.C. 154(b) by 119 days.

(21) Appl. No.: 15/754,469

(22) PCT Filed: Nov. 2, 2015

(86) PCT No.: PCT/JP2015/080898
§ 371 (c)(1),
(2) Date: Feb. 22, 2018

(87) PCT Pub. No.: WO2017/077568
PCT Pub. Date: May 11, 2017

(65) Prior Publication Data

US 2019/0021563 A1 Jan. 24, 2019

(51) Int. Cl.
*A47L 9/02* (2006.01)
*A47L 9/24* (2006.01)
(Continued)

(52) U.S. Cl.
CPC ..... *A47L 9/02* (2013.01); *A47L 9/0693* (2013.01); *A47L 9/242* (2013.01); *A47L 9/327* (2013.01)

(58) Field of Classification Search
CPC . A47L 9/02; A47L 9/242; A47L 9/327; A47L 9/064; A47L 9/244; A47L 9/248;
(Continued)

(56) References Cited

U.S. PATENT DOCUMENTS 2,763,517 A * 9/1956 Strand ..... B25G 3/38 403/58
4,819,293 A * 4/1989 Nicholson ..... A46B 5/0075 15/1.7
(Continued)

FOREIGN PATENT DOCUMENTS

CN 1537502 A 10/2004
EP 1364608 A2 11/2003
(Continued)

OTHER PUBLICATIONS

Written Opinion of the International Searching Authority dated Jan. 26, 2016 for the corresponding international application No. PCT/JP2015/080898.
(Continued)

*Primary Examiner* — Brian D Keller
(74) *Attorney, Agent, or Firm* — Posz Law Group, PLC

(57) ABSTRACT

A body included in a cleaning tool has a proximal end, a distal end, and a bottom surface that faces a surface to be cleaned when in use. A length from the proximal end to the distal end is longer than a width perpendicular to a longitudinal direction from the proximal end toward the distal end. A joint that connects a suction pipe being a wand to the body is positioned closer to the proximal end than to the distal end. The joint enables a first angle being an angle of a longitudinal axis of the wand with respect to the longitudinal direction of the body to be changed. The cleaning tool includes a locking mechanism that, when the first angle is equal to a holding angle of 90° or less, prevents the first angle from changing from the holding angle to a different angle.

12 Claims, 18 Drawing Sheets

(51) Int. Cl.
*A47L 9/32* (2006.01)
*A47L 9/06* (2006.01)

(58) Field of Classification Search
CPC ..... A47L 9/0666; A47L 9/093; A47L 9/00; A47L 9/0466
USPC ..... 15/246.2, 415.1
See application file for complete search history.

(56) References Cited

U.S. PATENT DOCUMENTS

| | | | | | |
|---|---|---|---|---|---|
| D359,853 | S * | 7/1995 | Haug | ..... | D4/129 |
| 6,345,408 | B1 * | 2/2002 | Nagai | ..... | A47L 9/02 15/361 |
| 6,553,613 | B2 * | 4/2003 | Onishi | ..... | A47L 9/02 15/351 |
| 7,740,193 | B2 * | 6/2010 | Soller | ..... | A47L 13/22 15/144.1 |
| 2004/0098829 | A1 * | 5/2004 | Song | ..... | A47L 9/0613 15/400 |

FOREIGN PATENT DOCUMENTS

| | | | | | |
|---|---|---|---|---|---|
| EP | 1 832 214 | A1 | | 9/2007 | |
| JP | 37-27170 | Y1 | | 10/1962 | |
| JP | H05-95862 | A | | 4/1993 | |
| JP | 10-258005 | A | | 9/1998 | |
| JP | 10-328096 | A | | 12/1998 | |
| JP | 3597366 | B2 | | 8/1999 | |
| JP | 2000-070198 | A | | 3/2000 | |
| JP | 2000-225079 | A | | 8/2000 | |
| JP | 2001-149283 | A | | 6/2001 | |
| JP | 2003-339587 | A | | 12/2003 | |
| JP | 2004-089736 | A | | 3/2004 | |
| JP | 2004089736 | | * | 3/2004 | ..... A47L 9/24 |
| JP | 3849667 | B2 | | 11/2004 | |
| JP | 2006-247077 | A | | 9/2006 | |
| JP | 2006-255373 | A | | 9/2006 | |
| JP | 2006255373 | A | * | 9/2006 | ..... A47L 9/02 |
| JP | 2007-236919 | A | | 9/2007 | |
| JP | 2007236919 | | * | 9/2007 | ..... A47L 9/02 |
| JP | 2008-012361 | A | | 1/2008 | |
| JP | 2010-166998 | A | | 8/2010 | |
| JP | 2013-070837 | A | | 4/2013 | |
| JP | 2013-94211 | A | | 5/2013 | |
| JP | 2013-132475 | A | | 7/2013 | |

OTHER PUBLICATIONS

Office Action dated Aug. 30, 2018 issued in the corresponding AU patent application No. 2015413756.
Taiwan Office Action dated Jul. 20, 2017 in the corresponding TW application No. 105105385. (with English translation).
International Search Report of the International Searching Authority dated Jan. 26, 2016 for the corresponding international application No. PCT/JP2015/080898 (and English translation).
International Preliminary Report on Patentability dated May 17, 2018 issued for the corresponding international application No. PCT/JP2015/080898.
Office Action dated Oct. 30, 2018 issued in the corresponding JP patent application No. 2017-548534 (with English translation).
Office Action dated Oct. 23, 2019 issued in corresponding JP patent application No. 2019-106098 (and English translation).
Notice of Submission of Publications dated Oct. 1, 2019 issued in corresponding JP patent application No. 2019-106098.
Office Action dated Dec. 26, 2019 issued in corresponding CN patent application No. 201580084172.4 (and English translation).
Notice of Submission of Publications dated Feb. 12, 2020 issued in corresponding JP patent application No. 2019-106098.
Office Action dated Mar. 17, 2020 in corresponding Japanese patent application No. 2019-106098 (with English translation), which is a divisional patent application of corresponding JP patent application No. 2017-548534.
Office Action dated Sep. 28, 2020 issued in corresponding CN patent application No. 201580084172.4( and English translation).
Office Action dated Mar. 9, 2021 issued in corresponding JP patent application No. 2020-150474 (and English translation).

* cited by examiner

CLEANING TOOL AND VACUUM CLEANER

CROSS REFERENCE TO RELATED APPLICATION

This application is a U.S. national stage application of International Application No. PCT/JP2015/080898 filed on Nov. 2, 2015, the disclosure of which is incorporated herein by reference.

TECHNICAL FIELD

The present invention relates to a cleaning tool and a vacuum cleaner.

BACKGROUND ART

PTL 1 cited below describes an electric cleaner including a floor nozzle and a small nozzle attachably and detachably mounted to the floor nozzle. The small nozzle includes a coupling tube and a turnable coupling portion of which a rear part is connected to the coupling tube so as to be vertically tiltable and of which a front part is rotatably coupled to a suction tool. The electric cleaner includes rotating direction turn stopping means which locks a turn in a rotating direction by the turnable coupling portion when the small nozzle separates from the floor nozzle.

CITATION LIST

Patent Literature

[PTL 1] Japanese Patent No. 3849667

SUMMARY OF INVENTION

Technical Problem

With the electric cleaner described in PTL 1, a narrow space can be cleaned with the small nozzle by detaching the floor nozzle. However, the floor nozzle must be remounted when subsequently cleaning a wide space. Thus, it is difficult to clean both a wide space and a narrow space in an efficient manner.

The present invention has been made in order to solve the problem described above and an object thereof is to provide a cleaning tool for a vacuum cleaner capable of readily and efficiently cleaning both wide and narrow spaces and to provide a vacuum cleaner including the cleaning tool.

Solution to Problem

A cleaning tool according to the present invention includes: a body including a proximal end, a distal end, and a bottom surface facing a surface to be cleaned during use, a length from the proximal end to the distal end being longer than a width perpendicular to a longitudinal direction from the proximal end toward the distal end; a rod-like or tube-like wand; a joint positioned closer to the proximal end than to the distal end, the joint configured to connect the wand to the body so that a first angle can be changed, the first angle being an angle of a longitudinal axis of the wand with respect to a longitudinal direction of the body; and a locking mechanism configured to prevent, when the first angle is equal to a holding angle of 90° or less, the first angle from changing from the holding angle to a different angle.

A vacuum cleaner according to the present invention includes the cleaning tool described above.

Advantageous Effects of Invention

According to the present invention, since the joint, configured to connect the wand to the body of the cleaning tool so that the first angle being the angle of the longitudinal axis of the wand with respect to the longitudinal direction of the body can be changed, is positioned closer to the proximal end than to the distal end of the body, and the locking mechanism configured to prevent, when the first angle is equal to the holding angle of 90° or less, the first angle from changing from the holding angle to an angle that differs from the holding angle is provided, a wide space and a narrow space can be readily and efficiently cleaned.

DESCRIPTION OF EMBODIMENTS

Figure 1:
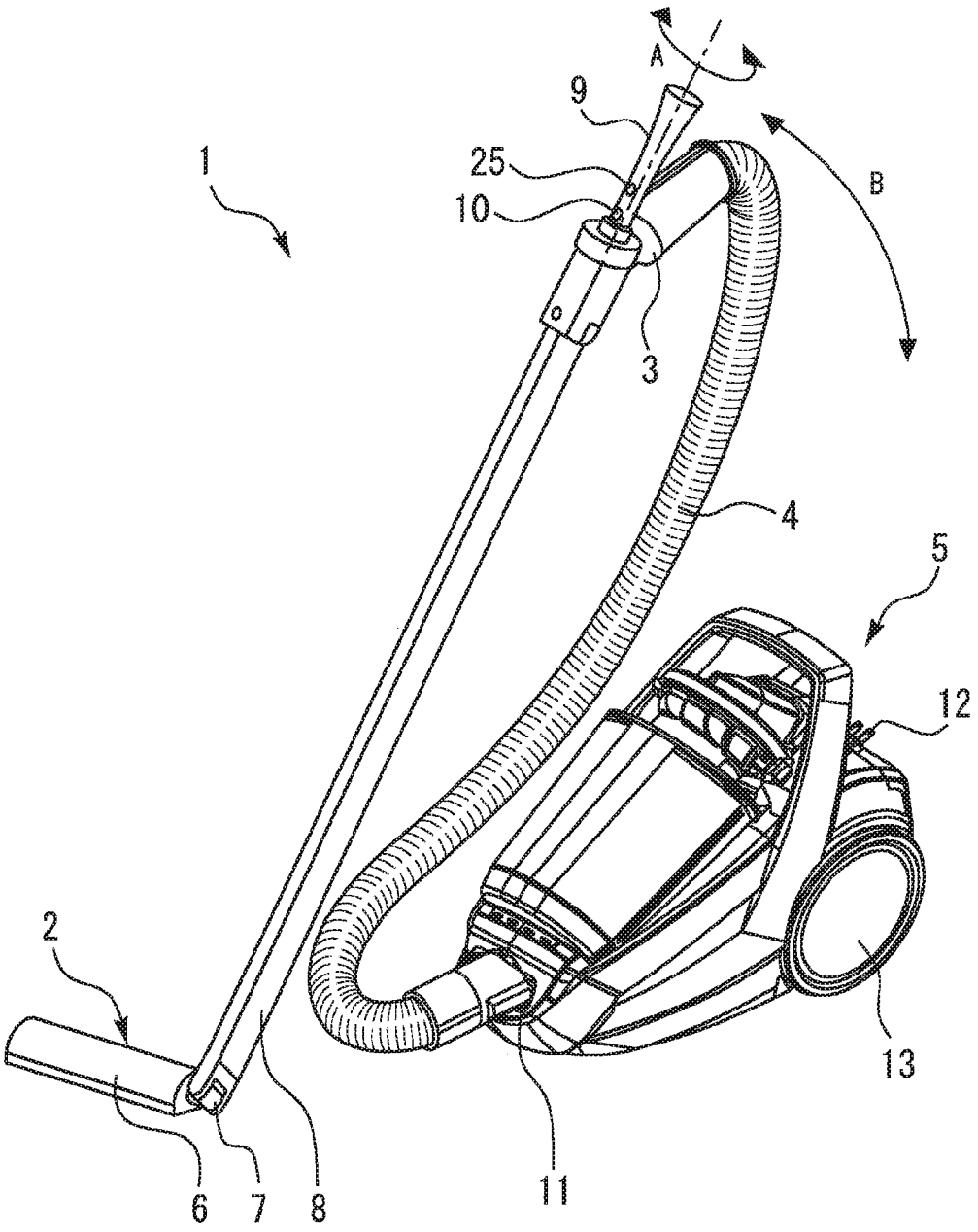
FIG. 1 is a perspective view of a vacuum cleaner including a cleaner tool according to a first embodiment.

Hereinafter, embodiments of the present invention will be described with reference to the drawings. Note that common elements in the drawings are denoted by same reference signs and overlapping descriptions will be simplified or omitted. Moreover, generally, the numbers, arrangements, orientations, shapes, and sizes of apparatuses, instruments, parts, and the like according to the present invention are not limited to the numbers, arrangements, orientations, shapes, and sizes depicted in the drawings. In addition, the present invention may include all possible combinations of combinable configurations among the configurations described in the respective embodiments below.

First Embodiment

FIG. 1 is a perspective view of a vacuum cleaner including a cleaning tool according to a first embodiment. As shown in FIG. 1, a vacuum cleaner (an electric cleaner) 1 according to the first embodiment includes a cleaning tool 2, a connection pipe 3, a suction hose 4, and a cleaner main body 5. The cleaning tool 2 includes a body 6, a joint 7, a suction pipe 8, and a handle 9. The connection pipe 3 is connected to the suction pipe 8 of the cleaning tool 2. The cleaner main body 5 includes a hose connection port 11, a power cord 12, and a wheel 13. The hose connection port 11 is positioned to the front of the cleaner main body 5. The wheel 13 is positioned on side surfaces on both sides of a rear-half portion of the cleaner main body 5.

The body 6 of the cleaning tool 2 sucks in dust on a surface to be cleaned (hereinafter, referred to as a "surface to be cleaned") together with air. The joint 7 turnably connects the suction pipe 8 to the body 6. The suction pipe 8 is a straight tube-like member. One end of the suction pipe 8 is connected to the joint 7. Another end of the suction pipe 8 is connected to one end of the connection pipe 3. The suction pipe 8 according to the present embodiment is an example of the wand.

The connection pipe 3 is a cylindrical member being bent midway. Another end of the connection pipe 3 is connected to one end of the suction hose 4. The suction hose 4 is a bellows member having flexibility. Another end of the suction hose 4 is connected to the hose connection port 1 of the cleaner main body 5. The cleaner main body 5 is for separating dust from air containing dust and discharging air from which dust has been removed. Hereinafter, air including dust will also be referred to as "dirty air". In addition, air from which dust has been removed will also be referred to as "clean air". For example, clean air is returned into a room from the cleaner main body 5.

When a user carries out cleaning using the vacuum cleaner 1, the user grips the handle 9. The handle 9 may be at least partially formed of a soft material such as a gel. At least partially forming the handle 9 of a soft material increases frictional force between the handle 9 and a hand gripping the handle 9 and enables the user to grip the handle 9 with greater ease. As a result, operability of the cleaning tool 2 can be further improved. The handle 9 may be formed of a material softer than the suction pipe 8. The handle 9 may have a rod shape. A central axis of the rod-like handle 9 may coincide with a central axis of the suction pipe 8. In FIG. 1, the central axis of the handle 9 and the central axis of the suction pipe 8 are indicated by a long dashed short dashed line. When an overall shape of the handle 9 is a rod-like shape that is coaxial with the central axis of the suction pipe 8, hand movement and muscle load when twisting the handle 9 decrease. As a result, handling of the cleaning tool 2 is facilitated and operability can be further improved. The handle 9 may be formed so that a cross-sectional area of a distal end part is greater than a cross-sectional area at center in a longitudinal direction. The handle 9 may be formed so that, in the longitudinal direction, a side further from the body 6 is thicker than a side closer to the body 6.

Both arrows shown in FIG. 1 indicate an example of how the handle 9 is moved. A movement in a twisting direction A is a rotation around the central axes of the handle 9 and the suction pipe 8. A movement in an inclination direction B is a movement that changes angles of the handle 9 and the suction pipe 8 relative to a floor surface.

An operation switch 10 and a lock release button 25 are installed on the handle 9. The operation switch 10 is provided at a position near a base of the handle 9. The operation switch 10 is used by the user to control operations of the vacuum cleaner 1. The lock release button 25 will be described later.

The power cord 12 is wound around a cord reel portion (not shown) inside the cleaner main body 5. As will be described later, an electric air blower is built into the cleaner main body 5. When the power cord 12 is connected to an external power source, power is supplied to internal devices including the electric air blower. The electric air blower is driven by supplying power thereto. The electric air blower performs a suction operation set in advance in accordance with an operation on the operation switch 10.

When the electric air blower performs a suction operation, dirty air is sucked into the body 6. The dirty air sucked into the body 6 passes inside the joint 7, the suction pipe 8, the connection pipe 3, and the suction hose 4 before being supplied to the cleaner main body 5. The body 6, the joint 7, the suction pipe 8, the connection pipe 3, and the suction hose 4 constitute an air channel that supplies dirty air to the cleaner main body 5.

Figure 2:
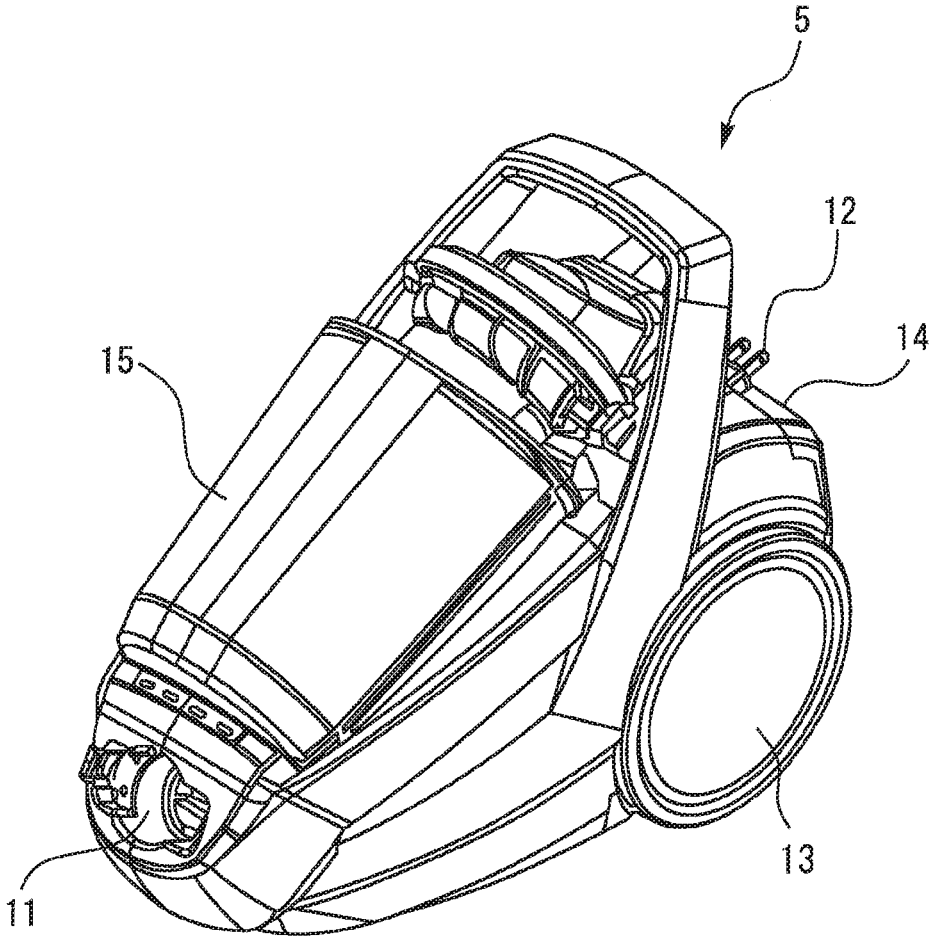
FIG. 2 is a perspective view of a cleaner main body according to the first embodiment.
Figure 3:
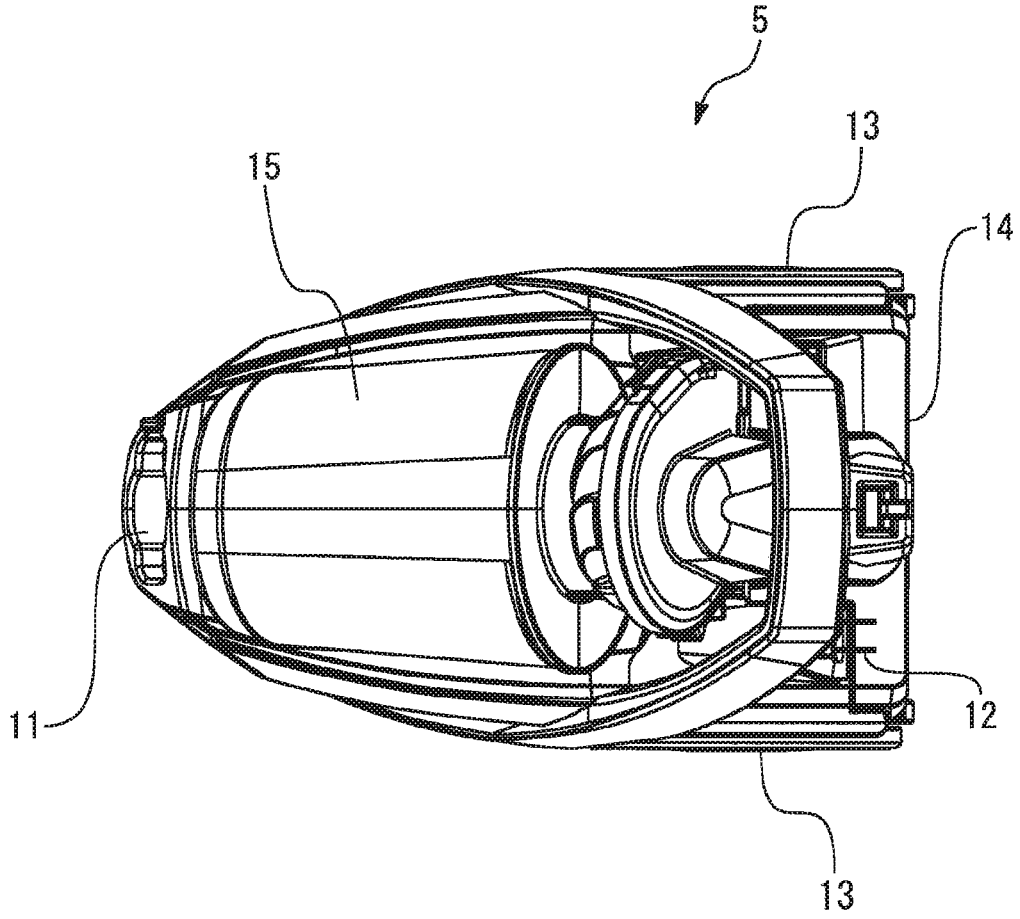
FIG. 3 is a plan view of the cleaner main body according to the first embodiment.

FIG. 2 is a perspective view of the cleaner main body 5 according to the first embodiment. FIG. 3 is a plan view of the cleaner main body 5 according to the first embodiment. As shown in FIGS. 2 and 3, the cleaner main body 5 includes a housing unit 14 and a dust collecting unit 15. The housing unit 14 houses various devices other than the dust collecting unit 15. The hose connection port 11 is formed in a front end portion of the housing unit 14. The wheel 13 is provided on side surfaces on both sides of a rear half of the housing unit 14. The dust collecting unit 15 is attachably and detachably mounted to the housing unit 14.

Figure 4:
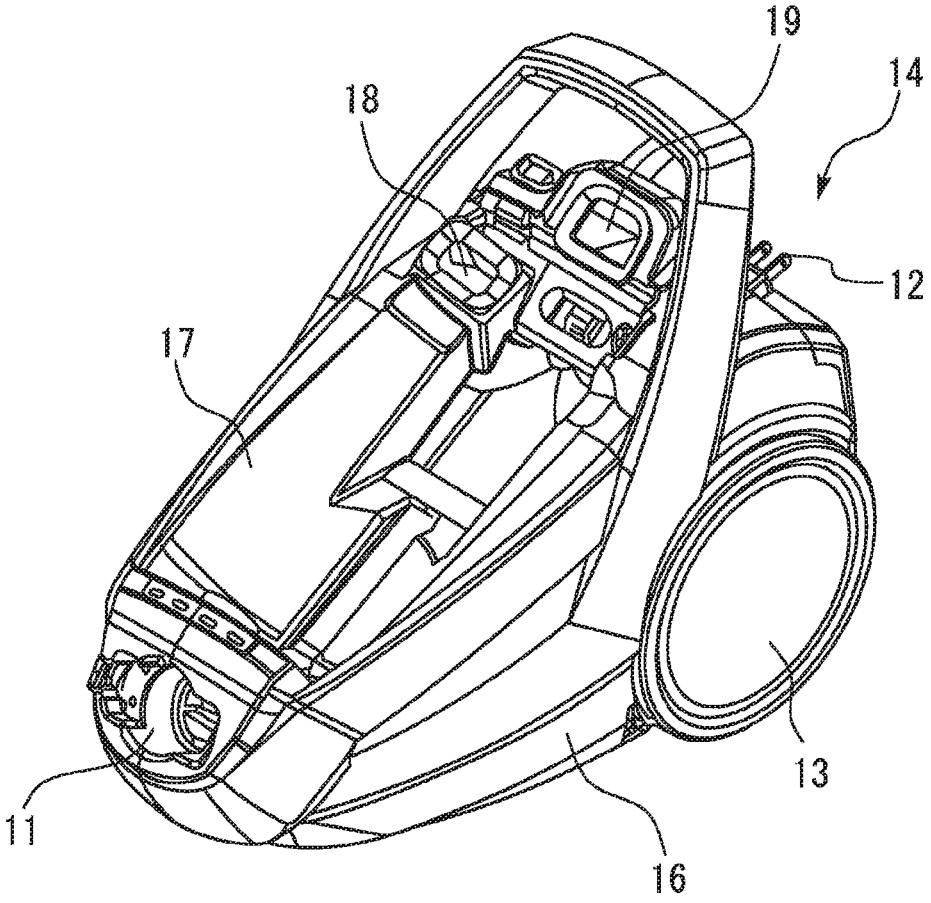
FIG. 4 is a perspective view of a housing unit according to the first embodiment.
Figure 5:
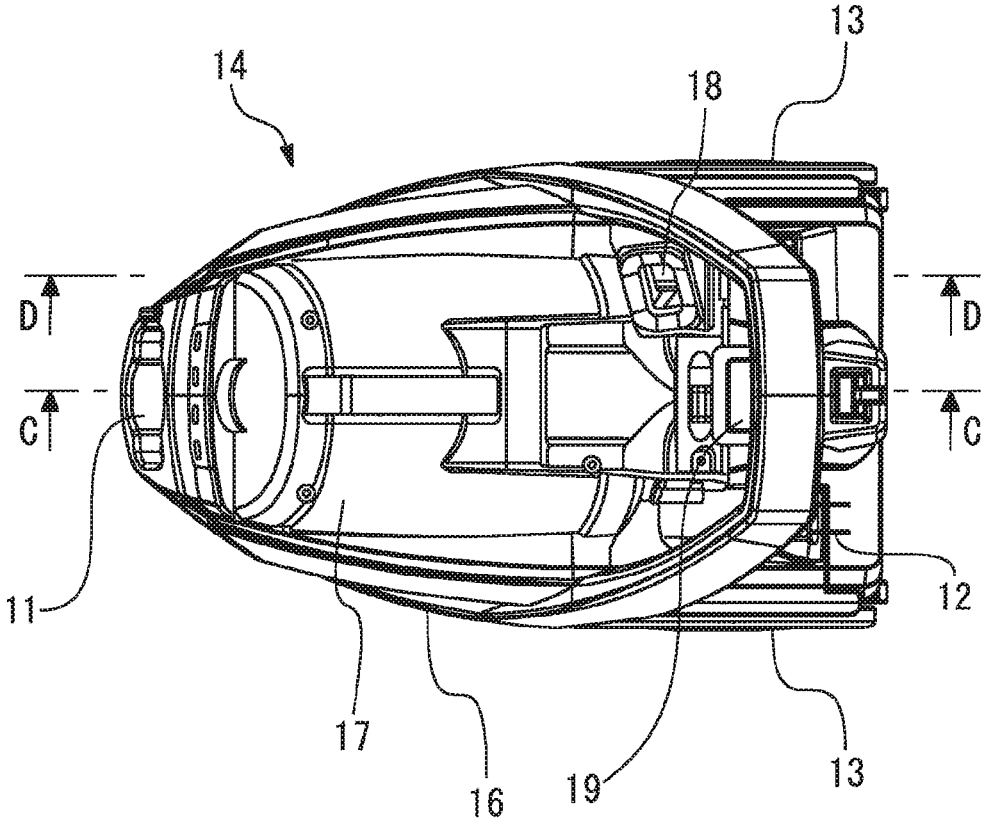
FIG. 5 is a plan view of the housing unit according to the first embodiment.

FIG. 4 is a perspective view of the housing unit 14 according to the first embodiment. FIG. 5 is a plan view of the housing unit 14 according to the first embodiment. FIGS. 4 and 5 show a state where the dust collecting unit 15 has been detached from the housing unit 14. As shown in FIGS. 4 and 5, the housing unit 14 includes a housing body 16 and a housing body 17.

The housing body 16 is a box-like member with an open upper part. The housing body 16 is, for example, a molded article. The electric air blower and the cord reel portion are housed inside the housing body 16. The housing body 17 is coupled to the housing body 16 so as to close the opening described above which is formed on the housing body 16. The housing body 17 includes a housing portion that is a space for housing the dust collecting unit 15. When the dust collecting unit 15 is appropriately mounted to the housing unit 14, a main portion of the dust collecting unit 15 is arranged in the housing portion. The dust collecting unit 15 is arranged above the housing body 17.

As shown in FIGS. 4 and 5, a first connection port 18 and a second connection port 19 are formed in the housing unit 14. The first connection port 18 and the second connection port 19 are arranged close to a rear end portion on an upper surface of the housing unit 14. The first connection port 18 is arranged close to one of the side surfaces of the housing unit 14. The second connection port 19 is arranged equidistantly from both side surfaces of the housing unit 14. The first connection port 18 and the second connection port 19 are communicated with an inside of the dust collecting unit 15 in a state where the dust collecting unit 15 is mounted to the housing unit 14.

Figure 6:
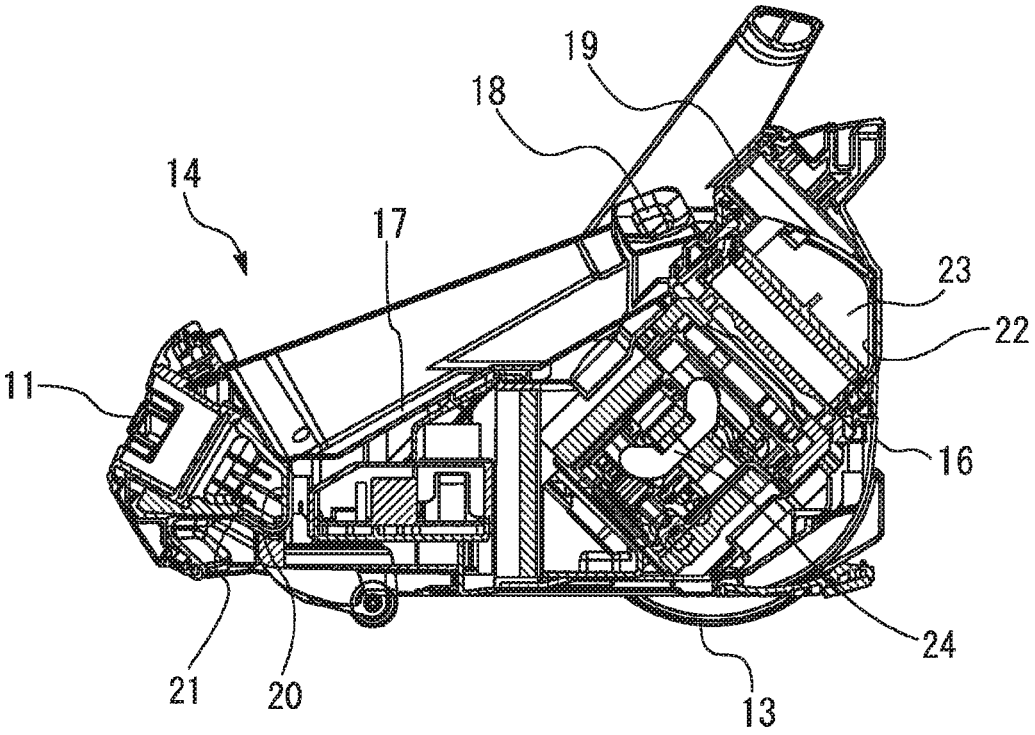
FIG. 6 is a cross-sectional view taken along line C-C of the housing unit shown in FIG. 5.
Figure 7:
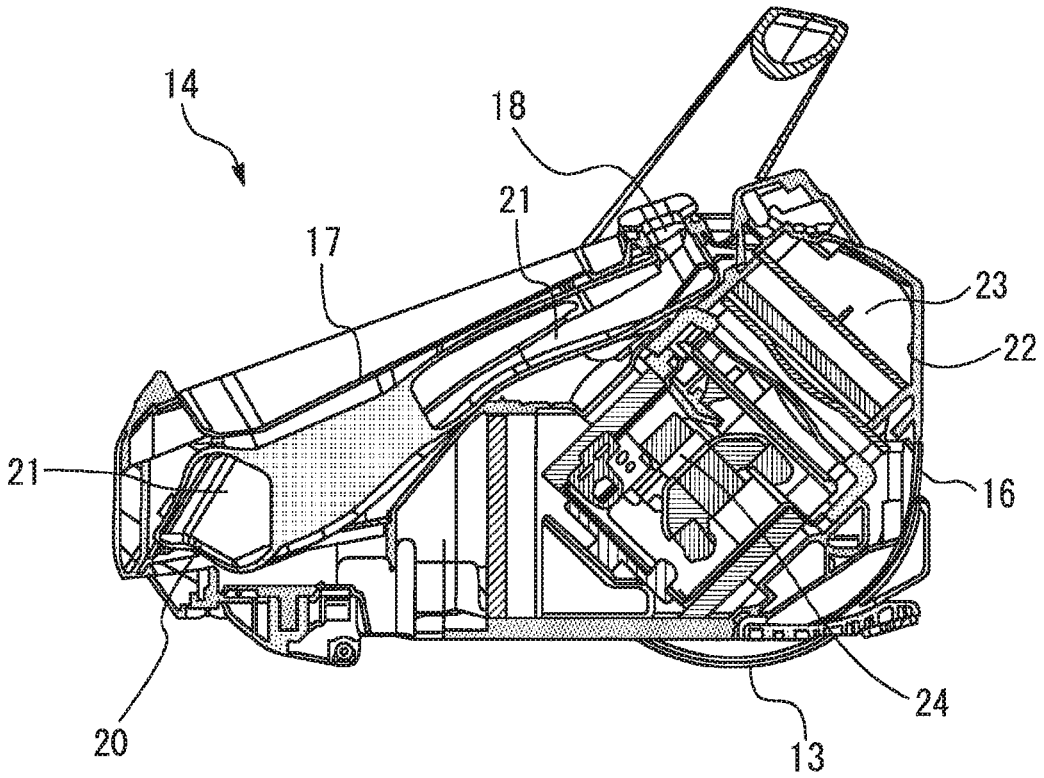
FIG. 7 is a cross-sectional view taken along line D-D of the housing unit shown in FIG. 5.

FIG. 6 is a cross-sectional view taken along line C-C of the housing unit 14 shown in FIG. 5. FIG. 7 is a cross-sectional view taken along line D-D of the housing unit 14 shown in FIG. 5. As shown in FIGS. 6 and 7, the housing unit 14 includes a suction air channel-forming portion 20. The suction air channel-forming portion 20 forms a suction air channel 21 for guiding dirty air to the dust collecting unit 15 in the cleaner main body 5. The suction air channel-forming portion 20 is provided so as to pass through an internal space of the housing body 16. One end of the suction air channel-forming portion 20 opens on a front surface of the housing unit 14. The one end of the suction air channel-forming portion 20 described above forms the hose connection port 11. Another end of the suction air channel-forming portion 20 opens on the upper surface of the housing unit 14. In other words, the other end of the suction air channel-forming portion 20 described above opens in the housing body 17. The other end of the suction air channel-forming portion 20 described above forms the first connection port 18 that is connected to the dust collecting unit 15.

The dust collecting unit 15 is for separating dust from dirty air and temporarily storing the separated dust. The dust collecting unit 15 separates dust from air using centrifugal force by causing dirty air to rotate inside the dust collecting unit 15. In other words, the dust collecting unit 15 is a cyclonic separator equipped with a cyclonic separation function.

As shown in FIGS. 6 and 7, the housing unit 14 includes an exhaust air channel-forming portion 22. The exhaust air channel-forming portion 22 forms an exhaust air channel 23 for guiding clean air discharged from the dust collecting unit 15 to an exhaust port (not shown) in the cleaner main body 5. The exhaust air channel-forming portion 22 is provided so as to pass through an internal space of the housing body 16. One end of the exhaust air channel-forming portion 22 opens on the upper surface of the housing unit 14. In other words, the one end of the exhaust air channel-forming portion 22 described above opens in the housing body 17. The one end of the exhaust air channel-forming portion 22 described above forms the second connection port 19 that is connected to the dust collecting unit 15. Another end of the exhaust air channel-forming portion 22 opens toward the outside of the housing unit 14. The other end of the exhaust air channel-forming portion 22 described above forms the exhaust port.

As shown in FIGS. 6 and 7, an electric air blower 24 is provided inside the housing unit 14. The electric air blower 24 is for generating an air flow in air channels formed in the vacuum cleaner 1. The air channels formed in the vacuum cleaner 1 refer to an air channel for allowing dirty air to flow into the cleaner main body 5 from the outside, the suction air channel 21, a space inside the dust collecting unit 15, and the exhaust air channel 23. The electric air blower 24 is arranged inside the exhaust air channel 23 at a position set in advance close to a rear end portion of the housing unit 14.

When the electric air blower 24 starts a suction operation, an air flow is generated in each air channel formed in the vacuum cleaner 1. At this point, a suction force is generated inside the cleaning tool 2, the connection pipe 3, and the suction hose 4. Dirty air sucked into the body 6 of the cleaning tool 2 is taken into the cleaner main body 5 from the hose connection port 11. The dirty air having flowed into the cleaner main body 5 passes through the suction air channel 21 and is supplied to the dust collecting unit 15 from the first connection port 18. Inside the dust collecting unit 15, dust is separated from the dirty air. Clean air discharged from the dust collecting unit 15 flows into the exhaust air channel 23 and passes through the electric air blower 24 inside the exhaust air channel 23. The clean air having passed through the electric air blower 24 proceeds further along the exhaust air channel 23 and is discharged to the outside of the cleaner main body 5 from the exhaust port.

Figure 8:
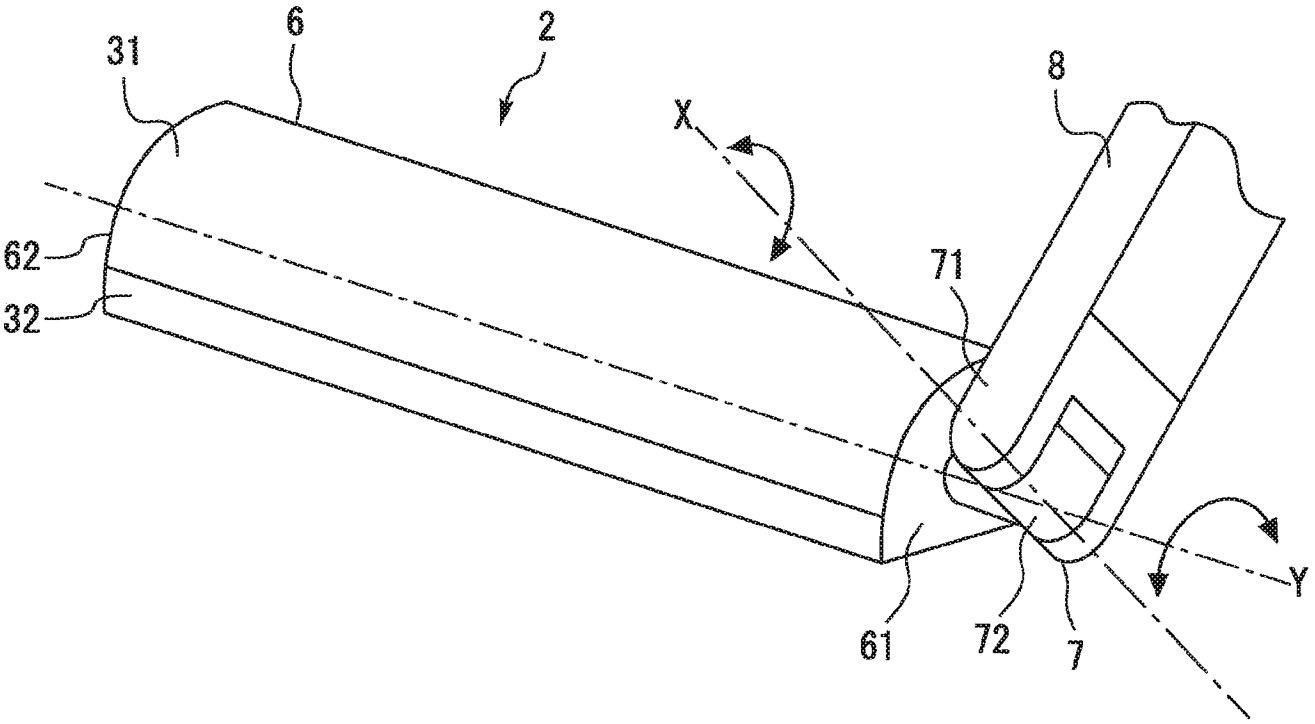
FIG. 8 is a perspective view of the cleaner tool according to the first embodiment.
Figure 9:
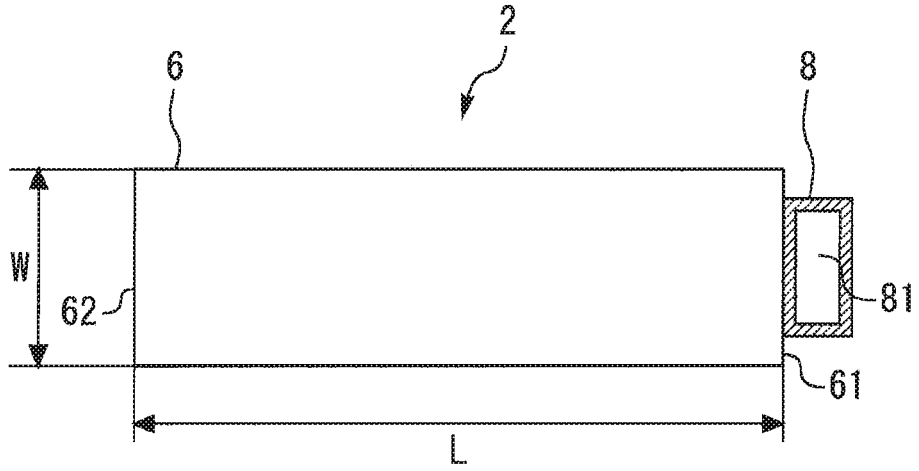
FIG. 9 is a plan view of the cleaner tool according to the first embodiment.
Figure 10:
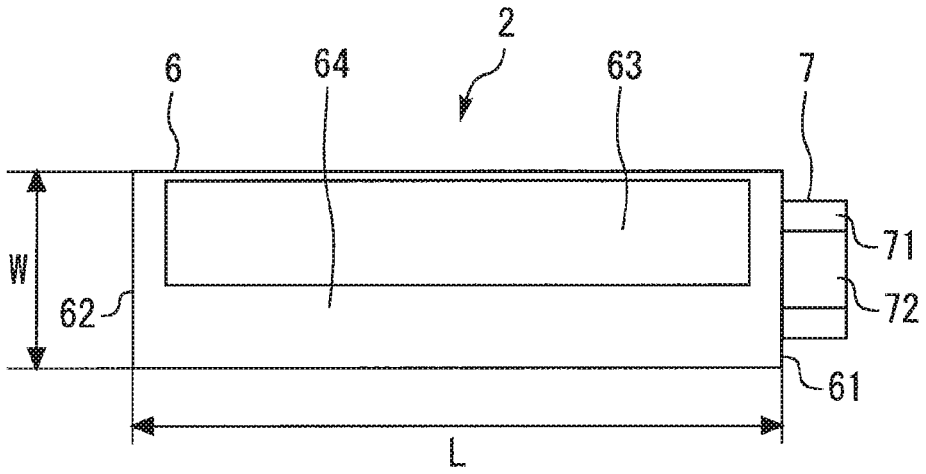
FIG. 10 is a bottom view of the cleaning tool according to the first embodiment.

FIG. 8 is a perspective view of the cleaning tool 2 according to the first embodiment. FIG. 9 is a plan view of the cleaning tool 2 according to the first embodiment. FIG. 9 shows a state where the suction pipe 8 is arranged perpendicular to the surface to be cleaned and the suction pipe 8 is cut at a midway position in the longitudinal direction. FIG. 10 is a bottom view of the cleaning tool 2 according to the first embodiment.

As shown in FIGS. 9 and 10, the body 6 of the cleaning tool 2 has a proximal end 61 and a distal end 62. L denotes a length (a maximum length) from the proximal end 61 to the distal end 62. A direction from the proximal end 61 toward the distal end 62 will be referred to as a longitudinal direction of the body 6. W denotes a width (a maximum width) of the body 6. The width W represents a size of the body 6 in a direction perpendicular to the longitudinal direction of the body 6 in a plan view. The length L of the body 6 is longer than the width W of the body 6. In the present embodiment, a shape of the body 6 in a plan view is roughly rectangular. Hereinafter, the direction perpendicular to the longitudinal direction of the body 6 in a plan view will be referred to as a width direction of the body 6.

In the present embodiment, the proximal end 61 and the distal end 62 extend linearly in a plan view. In addition to such a configuration, the proximal end 61 and the distal end 62 may at least partially form a curved line or a broken line in a plan view. In this case, the length L of the body 6 is to refer to a maximum length in the longitudinal direction between the proximal end 61 and the distal end 62 in a plan view. In the present embodiment, the width of the body 6 is approximately constant along the longitudinal direction of the body 6. In addition to such a configuration, the width of the body 6 may vary along the longitudinal direction of the body 6. In this case, the width W of the body 6 is to refer to a maximum width of the body 6.

As shown in FIG. 8, the body 6 may include an upper case 31 and a lower case 32. The joint 7 according to the present embodiment includes a first rotating portion 71 and a second rotating portion 72. The second rotating portion 72 is connected to the body 6 so as to be rotatable around a second axis of rotation Y. The first rotating portion 71 is connected to the second rotating portion 72 so as to be rotatable around a first axis of rotation X. The second axis of rotation Y is not parallel to the first axis of rotation X. The second axis of rotation Y is at an intersecting position or a skewed position with respect to the first axis of rotation X. In FIG. 8, the first axis of rotation X and the second axis of rotation Y are indicated by long dashed short dashed lines. In the present embodiment, the second axis of rotation Y is substantially parallel to the longitudinal direction of the body 6. The first axis of rotation X is substantially perpendicular to the second axis of rotation Y.

In the present embodiment, the joint 7 is connected to a surface corresponding to one end of the proximal end 61 of the body 6. In the present embodiment, the joint 7 is connected to an and surface of the proximal end 61 of the body 6. The second rotating portion 72 of the joint 7 is connected to the end surface of the proximal end 61 of the body 6 so as to be rotatable around the second axis of rotation Y.

In the present embodiment, the first rotating portion 71 of the joint 7 and the suction pipe 8 are integrally formed. In addition to such a configuration, the first rotating portion 71 of the joint 7 and the suction pipe 8 may be constituted by separate members and the two members may be attachably and detachably coupled to each other.

While an orientation of the first axis of rotation X changes as the second rotating portion 72 of the joint 7 rotates around the second axis of rotation Y, the first axis of rotation X is maintained perpendicular to the second axis of rotation Y. The second rotating portion 72 is rotatable around the second axis of rotation Y within an angular range set in advance with respect to the body 6. The first rotating portion 71 of the joint 7 is rotatable around the first axis of rotation X within an angular range set in advance with respect to the second rotating portion 72.

As shown in FIG. 9, a first suction channel 81 is formed inside the suction pipe 8. As shown in FIG. 10, the body 6 includes a suction opening 63. The suction opening 63 opens on a bottom surface 64 of the body 6. The bottom surface 64 of the body 6 faces the surface to be cleaned during use or, in other words, during cleaning. A second suction channel (not shown) which fluidly connects to the suction opening 63 and the first suction channel 81 is formed inside the joint 7.

When the electric air blower 24 operates, dirty air is sucked in from the suction opening 63. Subsequently, the dirty air passes through the second suction channel inside the joint 7 and the first suction channel 81 inside the suction pipe 8 and flows into the connection pipe 3.

The body 6 may further include a suction opening formed on a surface (for example, a side surface) other than the bottom surface 64 of the body 6. In this case, a total opening area of the suction opening formed on a surface other than the bottom surface 64 of the body 6 is desirably smaller than a total opening area of the suction opening 63 formed on the bottom surface 64 of the body 6. Adopting such a configuration produces the following effects. Since dust can be mainly sucked in from the suction opening 63 formed on the bottom surface 64 of the body 6, a variation in suction performance can be reduced.

Figure 11:
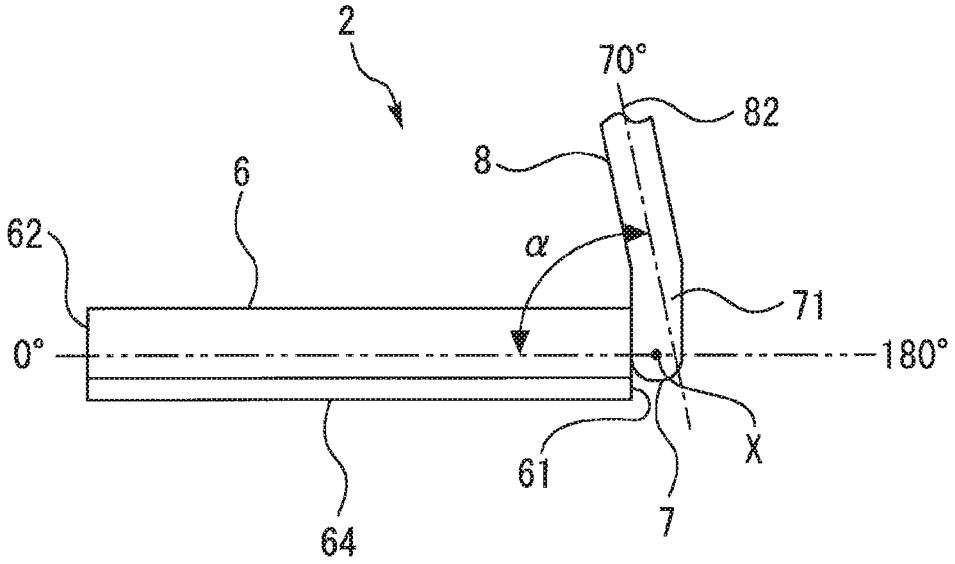
FIG. 11 is a side view of the cleaning tool according to the first embodiment as seen from a direction perpendicular to a longitudinal direction of a body.

FIG. 11 is a side view of the cleaning tool 2 according to the first embodiment as seen from a direction perpendicular to the longitudinal direction of the body 6. In the following description, an angle of a longitudinal axis 82 of the suction pipe 8 with respect to the longitudinal direction of the body 6 will be referred to as a first angle α. As shown in FIG. 11, a magnitude of the first angle α can be changed by rotating the joint 7 around the first axis of rotation X. The first angle α is assumed to correspond to an inferior angle among angles formed by the body 6 and the suction pipe 8. An angular range within which the joint 7 is rotatable around the first axis of rotation X may be, for example, a range within which the first angle α may change from 70° to 180° as shown in FIG. 11. The angular range within which the joint 7 is rotatable around the first axis of rotation X may be even wider and may be, for example, a range within which the first angle α may change from 0° to 180°.

As shown in FIG. 11, the longitudinal axis 82 of the suction pipe 8 may be inclined with respect to the first rotating portion 71 of the joint 7. Alternatively, as shown in FIG. 8, the longitudinal axis 82 of the suction pipe 8 may be coaxial with or parallel to the first rotating portion 71 of the joint 7. As shown in FIG. 9, when across-sectional shape of the first suction channel 81 in the suction pipe 8 is a polygonal shape, a line obtained by connecting an intersection of a perpendicular bisector of one side of the polygon and a perpendicular bisector of another side of the polygon in the longitudinal direction of the suction pipe 8 may be considered the longitudinal axis 82 of the suction pipe 8. In addition, when a cross-sectional shape of the first suction channel 81 in the suction pipe 8 is a circular shape, a line obtained by connecting a center of the circle in the longitudinal direction of the suction pipe 8 may be considered the longitudinal axis 82 of the suction pipe 8.

Figure 12:
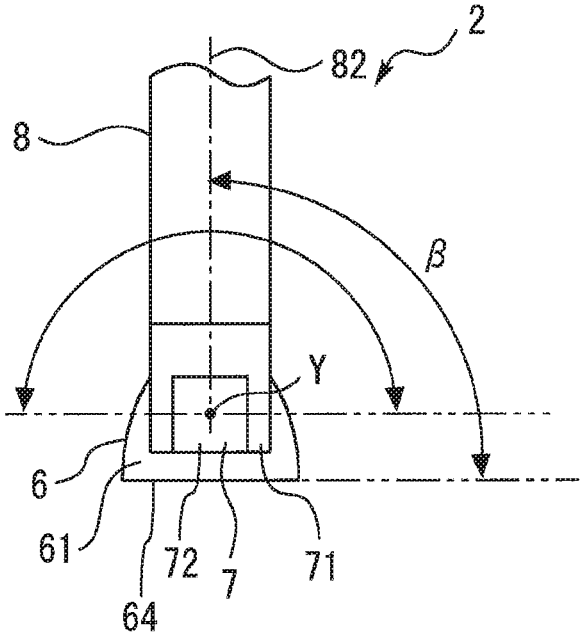
FIG. 12 is a side view of the cleaning tool according to the first embodiment as seen from a direction parallel to the longitudinal direction of the body.

FIG. 12 is a side view of the cleaning tool 2 according to the first embodiment as seen from a direction parallel to the longitudinal direction of the body 6. Both arrows shown in FIG. 12 indicate an angular range within which the joint 7 is rotatable around the second axis of rotation Y. In the following description, an angle between an imaginary plane including an imaginary line parallel to the longitudinal direction of the body 6 and the longitudinal axis 82 of the suction pipe 8, and the bottom surface 64 of the body 6, will be referred to as a second angle β. A magnitude of the second angle β can be changed by rotating the joint 7 around the second axis of rotation Y. An angular range within which the joint 7 is rotatable around the second axis of rotation Y may be, for example, a range within which the second angle β may change from 0° to 180° as shown in FIG. 12.

With the present embodiment, the following effects are produced. When the first angle α and the second angle β increase or decrease due to the rotation of the joint 7 around the second axis of rotation Y and the first axis of rotation X, an opening direction of the suction opening 63 is maintained. As described earlier, the suction pipe 8 coupled to the joint 7 can be tilted within an angular range set in advance with respect to the body 6 in a state where the opening direction of the suction opening 63 is maintained. Due to the joint 7 being rotatable around the second axis of rotation Y and the first axis of rotation X or, in other words, the first angle α and the second angle β being increasable and decreasable, a state where the bottom surface 64 of the body 6 is parallel to the surface to be cleaned can be maintained regardless of a movement in the twisting direction A and a movement in an inclination direction B shown in FIG. 1. In other words, a distance between the suction opening 63 and the surface to be cleaned does not change. Thus, a degree of vacuum around the suction opening 63 can be prevented from declining, and the body 6 can be operated while preferably maintaining suction performance.

FIGS. 9 to 12 show a state where the second angle β is 90°. As shown in FIGS. 9 and 10, in a state where the second angle β is 90°, sizes of the joint 7 and the suction pipe 8 along the width direction of the body 6 are smaller than the maximum width W of the body 6. In addition, as shown in FIG. 12, the joint 7 has a shape symmetrical via a plane which passes through a center of the width direction of the body 6 in plan view and which is perpendicular to the bottom surface 64 in a state where the second angle β is 90°.

In the following description, a narrow gap formed between pieces of furniture and the like will be referred to as a "narrow space". In addition, a cleaning tool having a joint at center in a longitudinal direction of a body of the cleaning tool as in the case of conventional cleaning tools will be referred to as a "center joint cleaning tool". With the present embodiment, the following effects are produced. A length from the distal end 62 of the body 6 to the joint 7 can be made longer than a length from an end of a body of a center joint cleaning tool to a joint. When cleaning a narrow space of which a width is equal to or greater than the width W of the body 6, by inserting the body 6 into the narrow space from a side of the distal end 62, the body 6 can be inserted deeper as compared to a center joint cleaning tool. Thus, the narrow space can be readily cleaned. A radius of rotation when rotating the body 6 around the joint 7 in a plan view is longer as compared to a center joint cleaning tool. A length of the body 6 in the longitudinal direction can be efficiently used. A cleaning range when rotating the body 6 can be expanded and cleaning can be performed efficiently in a short period of time.

In the present invention, the joint 7 need not be connected to a surface corresponding to one end of the proximal end 61 of the body 6. In the present invention, the joint 7 need not be connected to an end surface of the proximal end 61 of the body 6. In the present invention, the joint 7 need only be positioned closer to the proximal end 61 than to the distal end 62. In other words, the joint 7 need only be arranged at a position biased to a side of the proximal end 61 than to a center of the body 6 in the longitudinal direction. When the joint 7 is at a position that is closer to the proximal end 61 than to the distal end 62, the body 6 can be inserted deeper into the narrow space as compared to a center joint cleaning tool.

Figure 13:
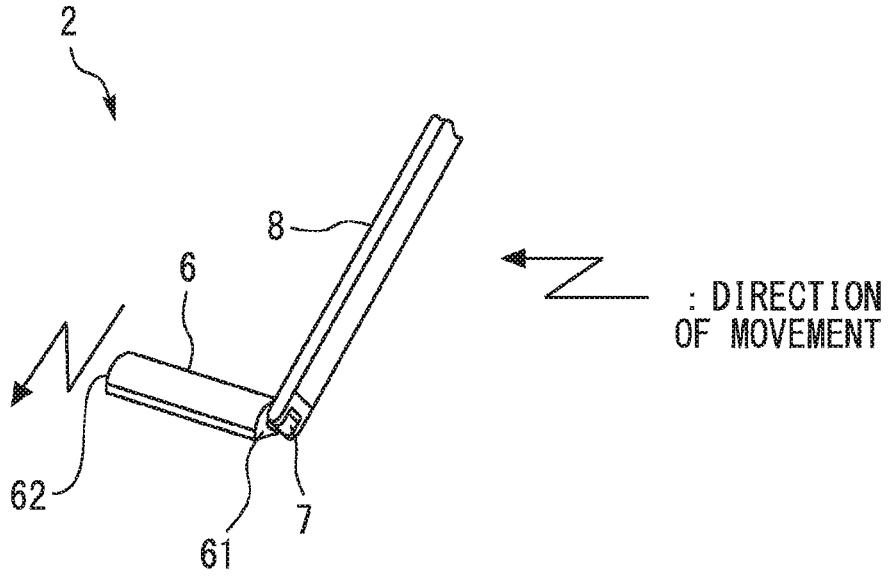
FIG. 13 is a perspective view showing a mode of use of the cleaning tool according to the first embodiment.
Figure 14:
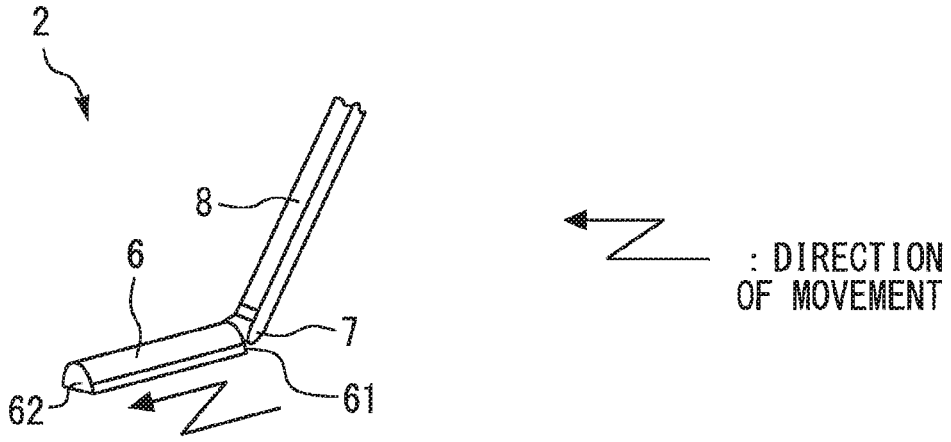
FIG. 14 is a perspective view showing another mode of use of the cleaning tool according to the first embodiment.

FIG. 13 is a perspective view showing a mode of use of the cleaning tool 2 according to the first embodiment FIG. 14 is a perspective view showing another mode of use of the cleaning tool 2 according to the first embodiment. FIG. 13 shows a mode of use in which the body 6 is moved along the width direction. FIG. 14 shows a mode of use in which the body 6 is moved along the longitudinal direction. Hereinafter, the mode of use shown in FIG. 13 will also be referred to as an "L-shape-mode" and the mode of use shown in FIG. 14 will also be referred to as an "I-shape-mode".

When carrying out cleaning using the vacuum cleaner 1, the user can operate an orientation of the body 6 of the cleaning tool 2 with a hand holding the handle 9. For example, when the handle 9 is rotated in a twisting direction A shown in FIG. 1, the joint 7 rotates and the orientation of the body 6 changes. By twisting the handle 9, the user can change an orientation of the body 6 when the body 6 is moved back and forth as viewed from the user. In this case, for example, the orientation of the body 6 can be changed between the L-shape-mode and the I-shape-mode. Setting the orientation of the body 6 to the L-shape-mode enables a wide space to be readily cleaned. Setting the orientation of the body 6 to the I-shape-mode enables a narrow area such as the narrow space to be readily cleaned. When the orientation of the body 6 changes between the L-shape-mode and the I-shape-mode, the body 6 can rotate without being separated from a surface to be cleaned. In the present embodiment, a radius of rotation of the body 6 at this point is approximately the same as a length L of the body 6 in a plan view.

With the present embodiment, the following effects are produced. The mode of use of the cleaning tool 2 can be changed between the L-shape-mode and the I-shape-mode depending on circumstances. For example, when cleaning a wide space such as a center of a room, a cleaning range can be widened by using the cleaning tool 2 in the L-shape-mode. For example, when cleaning a narrow space such as a gap between pieces of furniture, the body 6 can be deeply inserted into the narrow space by using the cleaning tool 2 in the I-shape-mode. By simply changing the orientation of the body 6, cleaning of a wide variety of scenes including wide spaces and narrow spaces can be accommodated. Since the need to remove and replace attachments suitable for a place to be cleaned can be reduced, a burden on the user can be eased.

The length L of the body 6 is favorably equal to or greater than 10 cm. When the length L of the body 6 is equal to or greater than 10 cm, a cleaning range when the cleaning tool 2 is used in the L-shape-mode and when the body 6 is rotated by a movement in the twisting direction A can be sufficiently widened. The length L of the body 6 is favorably equal to or less than 30 cm. When the length L of the body 6 is equal to or less than 30 cm, a suction force capable of sufficiently sucking in dust can be secured even at an end of the suction opening 63 which is positioned far from the joint 7.

With the present embodiment, since the joint 7 is connected to an end surface of the proximal end 61 of the body 6, the following effects are produced. Since a radius of rotation when rotating the body 6 around the joint 7 in a plan view can be further increased, cleaning can be performed even more efficiently. Since a height of the joint 7 from the surface to be cleaned is reduced and low places such as underneath a sofa can be cleaned with greater ease, operability of the cleaning tool 2 can be improved. The body 6 can be inserted more deeply into the narrow space. Thus, the narrow space can be particularly readily cleaned.

As shown in FIGS. 9, 10, and 12, in a state where the second angle β is 90°, the sizes of the joint 7 and the suction pipe 8 along the width direction of the body 6 are smaller than the maximum width W of the body 6. According to such a configuration, with the present embodiment, the following effects are produced. When a width of a narrow space is equal to or greater than the maximum width W of the body 6, the cleaning tool 2 can be inserted into the narrow space in the I-shape-mode and the narrow space can be cleaned.

As shown in FIG. 12, the joint 7 is positioned substantially at center in the width direction of the body 6. In other words, in a plan view, a connection portion between the joint 7 and an end surface of the proximal end 61 is positioned substantially at center of the width W of the body 6. According to such a configuration, with the present embodiment, the following effects are produced. When the cleaning tool 2 is inserted into a narrow space in the I-shape-mode, the joint 7 and the suction pipe 8 can be more reliably prevented from obstructing the cleaning tool 2. Since the body 6 is less likely to separate from the surface to be cleaned when the cleaning tool 2 is moved, high suction performance can be maintained and operability can be improved.

The cleaning tool 2 according to the present embodiment includes a locking mechanism 26. When the first angle α is equal to a holding angle, the locking mechanism 26 prevents the first angle α from changing to a different angle from the holding angle. When the first angle α is equal to the holding angle, the locking mechanism 26 according to the present embodiment prevents the joint 7 from rotating around the first axis of rotation X. The holding angle is an angle equal to or smaller than 90° and is an angle set in advance. For example, the holding angle may be an angle equal to the first angle α shown in FIG. 11. For example, the holding angle may be an angle which enables the cleaning tool 2 to be used in the L-shape-mode. In the present embodiment, when the first angle α equals the holding angle during the rotation of the joint 7 around the first axis of rotation X, the locking mechanism 26 operates so as to fix the first angle α. While a case where the cleaning tool 2 includes one locking mechanism 26 will be described in the present embodiment, in the present invention, a cleaning tool may include a plurality of locking mechanisms.

Figure 15:
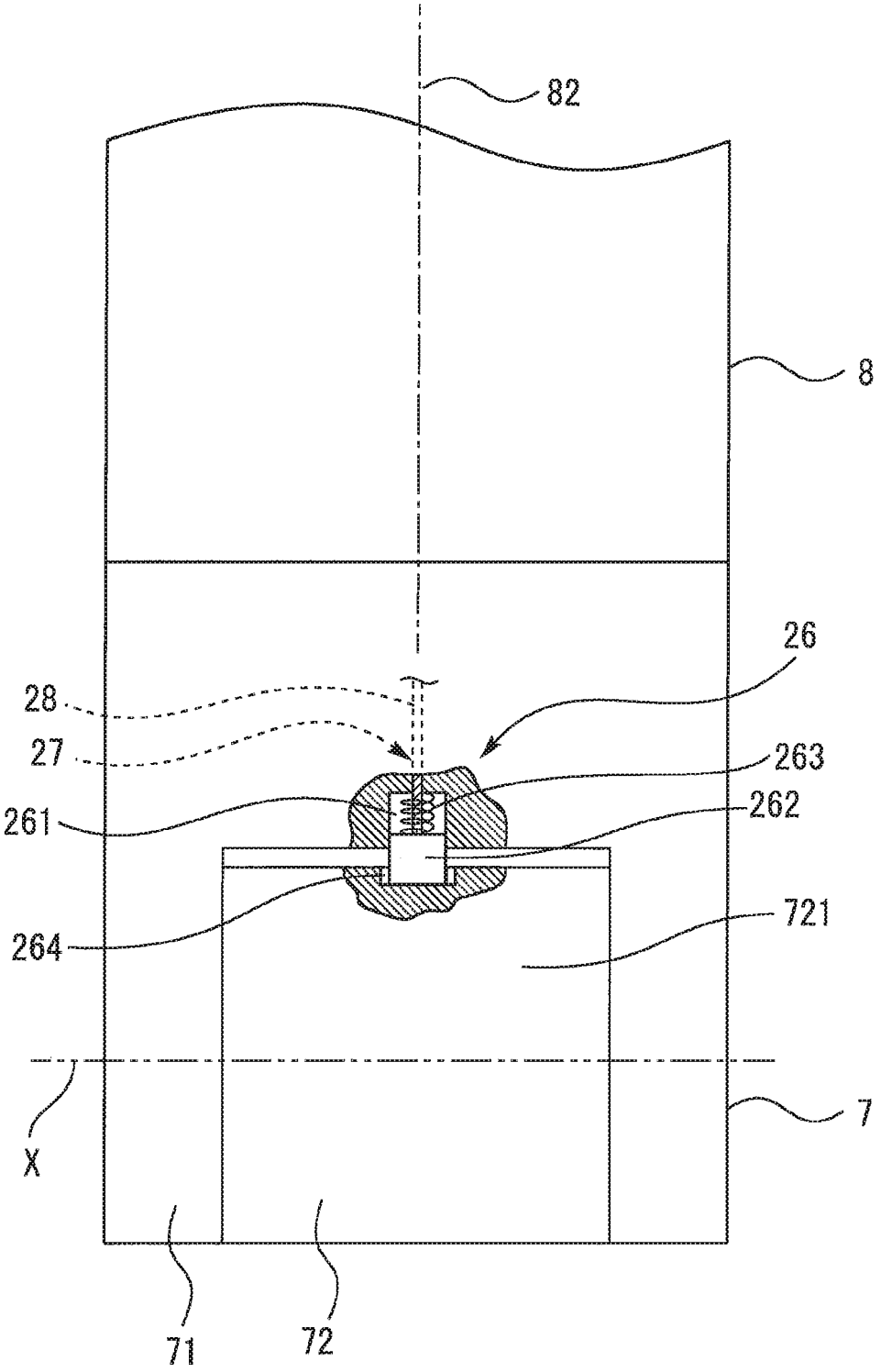
FIG. 15 is a diagram for illustrating a locking mechanism included in the cleaning tool according to the first embodiment.

FIG. 15 is a diagram for illustrating the locking mechanism 26 included in the cleaning tool 2 according to the first embodiment. FIG. 15 is a diagram viewing the joint 7 from a direction perpendicular to the first axis of rotation x and the longitudinal axis 82 of the suction pipe 8. FIG. 15 is partially a cross-sectional view. FIG. 15 shows a state where the locking mechanism 26 has operated so as to fix the first angle α. As shown in FIG. 15, the locking mechanism 26 according to the present embodiment includes a first recessed portion 261, a pin 262, a spring 263, and a second recessed portion 264. The first recessed portion 261 is formed in the first rotating portion 71 of the joint 7. The pin 262 is inserted into the first recessed portion 261. The pin 262 is movable so that a protrusion length from the first recessed portion 261 changes. The spring 263 is installed in the first recessed portion 261. The spring 263 biases the pin 262 in a direction in which the protrusion length of the pin 262 from the first recessed portion 261 increases. The second rotating portion 72 of the joint 7 includes an outer circumferential surface 721 having the first axis of rotation X as its center. The first recessed portion 261 faces the outer circumferential surface 721 of the second rotating portion 72. The second recessed portion 264 is formed on the outer circumferential surface 721 of the second rotating portion 72. The second recessed portion 264 is at a position facing the first recessed portion 261 when the first angle α equals the holding angle. When the first angle α is not equal to the holding angle, a tip of the pin 262 comes into contact with the outer circumferential surface 721 in a portion where the second recessed portion 264 is not formed. Since the tip of the pin 262 is slidable against the outer circumferential surface 721 when the first angle α is not equal to the holding angle, the first rotating portion 71 of the joint 7 is rotatable with respect to the second rotating portion 72 around the first axis of rotation X and the first angle α may change. When the first angle α becomes equal to the holding angle, the pin 262 pressed by the spring 263 protrudes and a part of the pin 262 is inserted into the second recessed portion 264. In other words, a state shown in FIG. 15 is created. In the state shown in FIG. 15, the pin 262 stops the first rotating portion 71 from rotating with respect to the second rotating portion 72. Thus, the first angle α is prevented from changing to a different angle from the holding angle.

With the present embodiment, the following effects are produced due to the inclusion of the locking mechanism 26. Due to the operation of the locking mechanism 26 during use in the L-shape-mode shown in FIG. 13, the first angle α can be held so that the first angle α does not change. When used in the L-shape-mode, the suction pipe 8 causes the body 6 to advance or retreat as seen from the user. At this point, a frictional force between the body 6 and the surface to be cleaned causes forces described below to be applied. When the suction pipe 8 causes the body 6 to advance as seen from the user, a force causing the first angle α to decrease is applied. When the suction pipe 8 causes the body 6 to retreat as seen from the user, a force causing the first angle α to increase is applied. Assuming that the locking mechanism 26 is not provided, the first angle α changes or the handle 9 is twisted every time the suction pipe 8 causes the body 6 to advance or retreat as seen from the user, making cleaning more difficult. In contrast, with the present embodiment, due to the inclusion of the locking mechanism 26, a change in the first angle α can be prevented and excellent operability can be obtained when used in the L-shape-mode.

When used in the L-shape-mode, the handle 9 may be operated so as to lift the body 6 up from the surface to be cleaned in order to avoid a stepped floor or to move the body 6 to another location. In this case, assuming that the locking mechanism 26 is not provided, a rotation of the joint 7 in a direction in which the first angle α increases causes the body 6 to tilt so as to lower the distal end 62. When the body 6 is once again lowered to the surface to be cleaned from this state, there is a risk that the distal end 62 may collide with the surface to be cleaned. In contrast, with the present embodiment, due to the inclusion of the locking mechanism 26, tilting of the body 6 when the body 6 is lifted up from the surface to be cleaned in the L-shape-mode can be prevented and a state where the bottom surface 64 and the suction opening 63 of the body 6 are parallel or nearly parallel to the surface to be cleaned can be maintained. Thus, the body 6 can be once again lowered to the surface to be cleaned smoothly and readily.

A configuration may be adopted in which, when a force equal to or greater than a threshold is applied in a direction that causes the first angle α to change while the first angle α is prevented from changing to an angle that differs from the holding angle by the locking mechanism 26, the fixation of the first angle α by the locking mechanism 26 is released. In this case, the threshold desirably satisfies the following conditions. When the suction pipe 8 causes the body 6 to advance or retreat as seen from the user in the L-shape-mode, desirably, the fixation of the first angle α by the locking mechanism 26 is not automatically released. When the suction pipe 8 lifts the body 6 up from the surface to be cleaned in the L-shape-mode, desirably, the fixation of the first angle α by the locking mechanism 26 is not automatically released.

When the fixation of the first angle α by the locking mechanism 26 is released, the first angle α can be changed once again. In this case, the first angle α may become an acute angle that is smaller than the holding angle. In other words, the holding angle may exist in the middle of an angular range within which the first angle α can change.

The cleaning tool 2 according to the present first embodiment includes a releasing mechanism 27 that releases, in response to an operation performed on the lock release button 25, the fixation of the first angle α by the locking mechanism 26. As shown in FIG. 1, the lock release button 25 is an example of an operating portion installed on the handle 9. As shown in FIG. 15, the releasing mechanism 27 includes a wire 28. One end of the wire 28 is coupled to the pin 262 of the locking mechanism 26. When the wire 28 is pulled in a state where the locking mechanism 26 is operating, due to the pin 262 being pulled into the first recessed portion 261 and the pin 262 slipping out from the second recessed portion 264, the fixation of the first angle α by the locking mechanism 26 is released. Although not shown, another end of the wire 28 extends into the handle 9 along the joint 7 and the suction pipe 8. A mechanism (not shown)

which converts a movement when the lock release button 25 is pressed into a movement of pulling the wire 28 is built into the handle 9. When the user presses the lock release button 25 in a state where the locking mechanism 26 is operating, the wire 28 is pulled and the fixation of the first angle α by the locking mechanism 26 is released. With the present embodiment, the following effects are produced. When the user desires to change the first angle α in a state where the first angle α is fixed by the locking mechanism 26, the fixation of the first angle α by the locking mechanism 26 can be released by simply changing a position of a finger gripping the handle 9 to press the lock release button 25. Thus, a large force need not be applied to the handle 9 in a direction that distances the body 6 and the suction pipe 8. Accordingly, since the body 6 does not tilt so that the distal end 62 of the body 6 separates from the surface to be cleaned, a temporary decline in suction performance can be reliably suppressed. In addition, since an operation involving pinning down the body 6 with a foot or the like need not be performed, hassle does not occur.

Configurations of the locking mechanism 26 and the releasing mechanism 27 according to the present embodiment are simply examples. The locking mechanism 26 and the releasing mechanism 27 according to the present embodiment can be replaced with other configurations capable of exhibiting same or similar functions. For example, a configuration may be adopted in which, in place of the releasing mechanism 27 described above, the locking mechanism 26 is released by transmitting an operation performed on the lock release button 25 with an electrical signal to operate an actuator.

During use in the L-shape-mode shown in FIG. 13, the second angle β may change. The locking mechanism 26 according to the present first embodiment does not prevent the second angle β from changing. Thus, since the locking mechanism 26 does not prevent the second angle β from changing during use in the L-shape-mode shown in FIG. 13, preferable operability can be achieved. As long as the locking mechanism 26 does not prevent the second angle β from changing at least during use in the L-shape-mode or, in other words, at least when the first angle α is equal to the holding angle, an effect similar to that described above can be produced.

Second Embodiment

Figure 16:
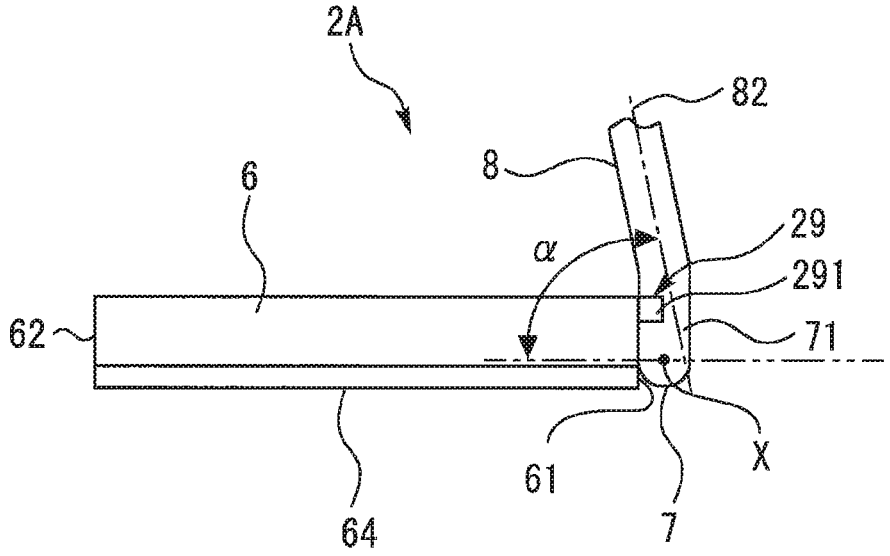
FIG. 16 is a side view of a cleaning tool according to a second embodiment as seen from a direction perpendicular to a longitudinal direction of a body.
Figure 17:
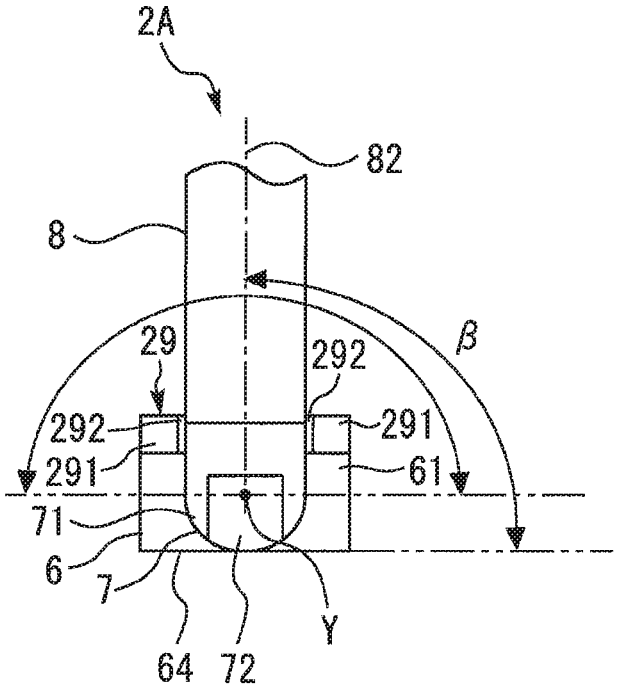
FIG. 17 is a side view of the cleaning tool according to the second embodiment as seen from a direction parallel to the longitudinal direction of the body.
Figure 18:
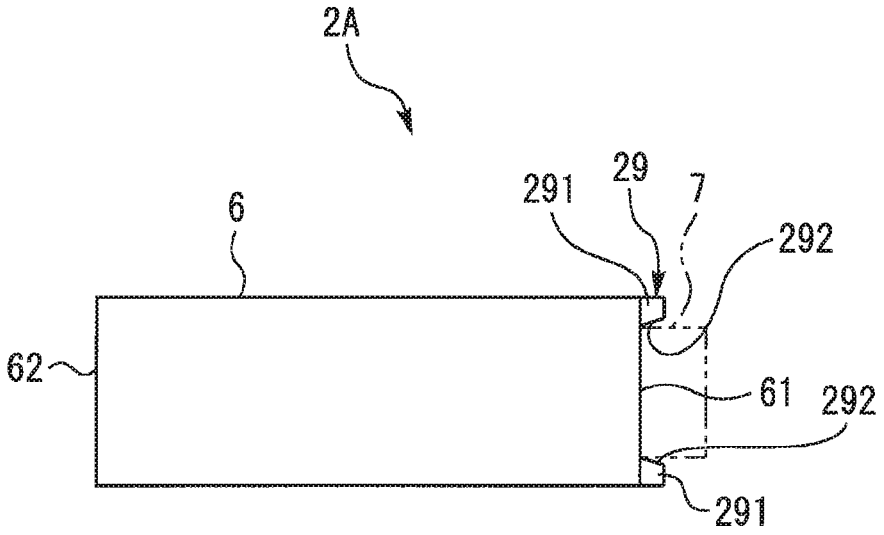
FIG. 18 is a plan view of the cleaning tool according to the second embodiment.

Next, while a second embodiment will be described with reference to FIGS. 16 to 18, the description will focus on differences from the first embodiment described above and descriptions of same or equivalent portions will be simplified or omitted. FIG. 16 is a side view of a cleaning tool 2A according to the second embodiment as seen from a direction perpendicular to the longitudinal direction of the body 6. FIG. 17 is a side view of the cleaning tool 2A according to the second embodiment as seen from a direction parallel to the longitudinal direction of the body 6. FIG. 18 is a plan view of the cleaning tool 2A according to the second embodiment. In FIG. 18, an external shape of the joint 7 is indicated by an imaginary long dashed double-short dashed line. FIGS. 16 to 18 show a state where the first angle α is equal to the holding angle and the second angle β is 90°.

The cleaning tool 2A according to the second embodiment shown in FIGS. 16 to 18 includes a locking mechanism 29. As shown in FIG. 18, the locking mechanism 29 includes a pair of protruding portions 291 that protrude from an end surface of the proximal end 61 of the body 6. The protruding portion 291 has a contact surface 292. As shown in FIG. 17, the end surface of the proximal end 61 of the body 6 has a rectangular shape. The protruding portion 291 is formed in each of the two upper corners of the rectangular shape.

When the first angle α is made equal to the holding angle in a state where the second angle β is 90°, the first rotating portion 71 of the joint 7 is inserted between the pair of protruding portions 291. In a state where the first rotating portion 71 of the joint 7 is inserted between the pair of protruding portions 291, the pair of contact surfaces 292 comes into contact with the first rotating portion 71 of the joint 7. In this state, movement of the joint 7 is fixed due to a frictional force between the pair of contact surfaces 292 and the first rotating portion 71 of the joint 7. In a state where the first rotating portion 71 of the joint 7 is inserted between the pair of protruding portions 291, the first angle α and the second angle β are fixed so as not to change. In this manner, when the first angle α is equal to the holding angle and the second angle β is 90°, the locking mechanism 29 prevents the first angle α and the second angle β from changing.

From the state shown in FIG. 16, by applying a force to the body 6 and the suction pipe 8 in a direction in which the first angle α increases, fixation by the locking mechanism 29 can be released. From the state shown in FIG. 16, by rotating the suction pipe 8 with respect to the body 6 so as to increase the first angle α, the first rotating portion 71 of the joint 7 slips out from between the pair of protruding portions 291. Accordingly, the fixation by the locking mechanism 29 is released.

As shown in FIG. 18, the pair of contact surfaces 292 is tilted in the following manner. A distance between the pair of contact surfaces 292 at a position of a base of the protruding portions 291 is smaller than a distance between the pair of contact surfaces 292 at a position of a tip of the protruding portions 291. According to such a configuration, the following effect is produced. When the joint 7 is inserted between the pair of protruding portions 291, the deeper the position of the joint 7 between the pair of protruding portions 291, the greater the frictional force between the contact surfaces 292 and the joint 7. As a result, the locking mechanism 29 can more reliably fix the joint 7. When releasing the locking mechanism 29, the frictional force between the contact surfaces 292 and the joint 7 gradually decreases as the joint 7 slips out from between the pair of protruding portions 291. Thus, a force necessary for releasing the locking mechanism 29 can be reduced.

As shown in FIG. 16, the holding angle according to the present second embodiment corresponds to a smallest angle in a range within which the first angle α is changeable. In a state where the first angle α and the second angle β are fixed by the locking mechanism 29, the suction pipe 8 is desirably positioned between the distal end 62 of the body 6 and the joint 7 in a plan view.

With the present second embodiment, the following effects are produced. In a state where the first angle α and the second angle β are fixed by the locking mechanism 29, a state is created where the cleaning tool 2A is self-standing or nearly self-standing. In the event that the cleaning tool 2A is set aside when not in use or when suspending cleaning in order to carry out other chores, fixing the first angle α and the second angle β with the locking mechanism 29 enables the cleaning tool 2A to readily stand on its own or to be readily propped against a wall or the like.

As shown in FIG. 16, a lower end of the joint 7 is positioned at the same height as the bottom surface 64 of the body 6. As shown in FIG. 17, an end of the joint 7 has an arc-shape centered around the second axis of rotation Y when viewed from a direction parallel to the longitudinal direction of the body 6. When the joint 7 rotates around the second axis of rotation Y, the lower end of the joint 7 is maintained at the same height as the bottom surface 64 of the body 6. According to such a configuration, the following effect is produced. When a force causing the suction pipe 8 to press the joint 7 downward is applied during use, the distal end 62 of the body 6 can be reliably prevented from elevating from the surface to be cleaned due to the lower end of the joint 7 coming into contact with the surface to be cleaned. As a result, operability can be further improved. In contrast, assuming that the lower end of the joint 7 does not come into contact with the surface to be cleaned when a force causing the suction pipe 8 to press the joint 7 downward is applied during use, the distal end 62 of the body 6 may possibly elevate from the surface to be cleaned due to the principle of leverage.

Third Embodiment

Figure 19:
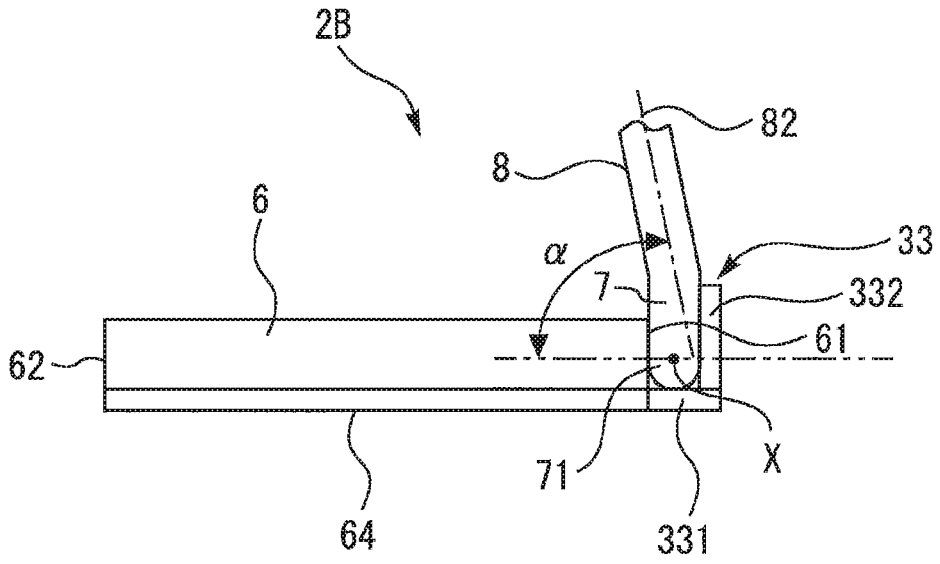
FIG. 19 is a side view of a cleaning tool according to a third embodiment as seen from a direction perpendicular to a longitudinal direction of a body.
Figure 20:
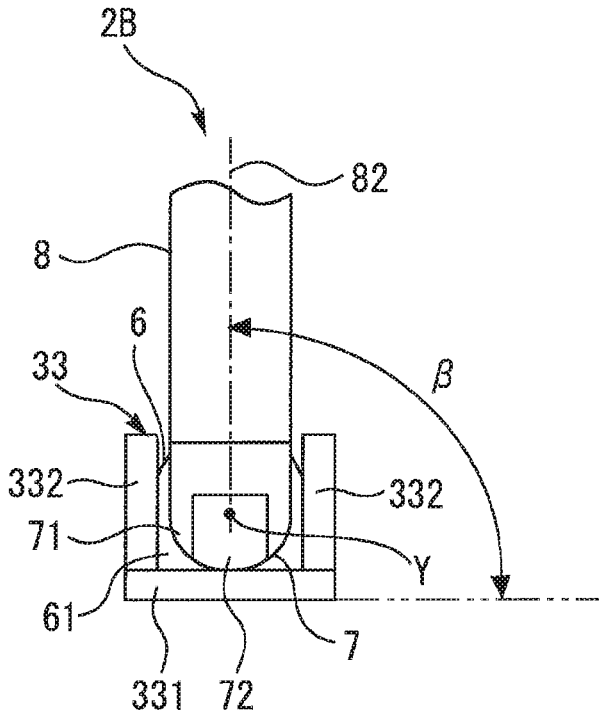
FIG. 20 is a side view of the cleaning tool according to the third embodiment as seen from a direction parallel to the longitudinal direction of the body.

Next, while a third embodiment will be described with reference to FIGS. 19 and 20, the description will focus on differences from the first embodiment described above and descriptions of same or equivalent portions will be simplified or omitted. FIG. 19 is a side view of a cleaning tool 2B according to the third embodiment as seen from a direction perpendicular to the longitudinal direction of the body 6. FIG. 20 is a side view of the cleaning tool 2B according to the third embodiment as seen from a direction parallel to the longitudinal direction of the body 6. FIGS. 19 and 20 show a state where the first angle α is equal to the holding angle and the second angle β is 90°.

The cleaning tool 2B according to the third embodiment shown in FIGS. 19 and 20 includes a locking mechanism 33. The locking mechanism 33 includes a supporting portion 331 and a pair of protruding portions 332. As shown in FIG. 19, the supporting portion 331 protrudes from an end surface of the proximal end 61 of the body 6. When the body 6 is placed on the surface to be cleaned, the supporting portion 331 is at least partially positioned between the joint 7 and the surface to be cleaned. In other words, the supporting portion 331 is at least partially positioned between an imaginary plane created by extending the bottom surface 64 of the body 6 toward a lower side of the joint 7 and the joint 7. The pair of protruding portions 332 protrudes upward from the supporting portion 331 or, in other words, in a direction perpendicular to the bottom surface 64. A distance between the end surface of the proximal end 61 of the body 6 and the pair of protruding portions 332 is as follows. When the first angle α is equal to the holding angle, the joint 7 can be inserted between the proximal end 61 of the body 6 and the protruding portions 332. The holding angle according to the present third embodiment corresponds to a smallest angle in a range within which the first angle α is changeable.

As shown in FIG. 20, a distance between the pair of protruding portions 332 when viewed from a direction parallel to the longitudinal direction of the body 6 is large enough to enable insertion of the joint 7 when the second angle β is 90°. When the joint 7 rotates around the second axis of rotation Y from the state shown in FIG. 20, the joint 7 is inserted between the proximal end 61 of the body 6 and any of the protruding portions 332. When the first angle α is equal to the holding angle, since the joint 7 is insertable between the proximal end 61 of the body 6 and the protruding portions 332, the second angle β becomes changeable. When the second angle β is 90°, since the joint 7 is insertable between the pair of protruding portions 332, the first angle α can change from the holding angle to a greater angle. The joint 7 is inserted between the pair of protruding portions 332 when the first angle α becomes greater than the holding angle.

In a state where the joint 7 is inserted between the proximal end 61 of the body 6 and any of the protruding portions 332, the second angle β becomes an angle other than 90°. In this state, the first angle α is prevented from becoming greater than the holding angle due to the joint 7 coming into contact with the protruding portions 332.

According to the present third embodiment, the following effects are produced. When the second angle β is 90°, the locking mechanism 33 allows the first angle α to change from the holding angle to a different angle. The locking mechanism 33 may allow the first angle α to change from the holding angle to a different angle when the second angle β is within a prescribed angular range that includes 90°. In the configuration shown in FIG. 20, a distance between the pair of protruding portions 332 when viewed from a direction parallel to the longitudinal direction of the body 6 is slightly larger than the width of the joint 7 when the second angle β is 90°. Thus, when the second angle β is within a prescribed angular range that includes 90°, the first angle α is allowed to change from the holding angle to a different angle. When the second angle β is not within this angular range, the joint 7 is inserted between the proximal end 61 of the body 6 and any of the protruding portions 332 in order to prevent the first angle α from becoming greater than the holding angle. As described above, the locking mechanism 33 according to the present third embodiment allows the first angle α to change from the holding angle to a different angle when the second angle β is within a prescribed angular range that at least includes 90°, but the locking mechanism 33 prevents the first angle α from changing from the holding angle to a different angle when the second angle β is not within this angular range.

With the present third embodiment, the following effects are produced. During use in the L-shape-mode shown in FIG. 13, the first angle α becomes equal to the holding angle while the second angle β becomes an angle other than 90°. In this state, the first angle α is prevented by the locking mechanism 33 from changing to a different angle from the holding angle. Thus, when the suction pipe 8 causes the body 6 to advance or retreat as seen from the user, a change in the first angle α can be prevented and excellent operability can be attained. In addition, when the body 6 is lifted up from the surface to be cleaned in the L-shape-mode, tilting of the body 6 can be prevented and a state where the bottom surface 64 and the suction opening 63 of the body 6 are parallel or nearly parallel to the surface to be cleaned can be maintained. Thus, the body 6 can be once again lowered to the surface to be cleaned smoothly and readily. When the first angle α is equal to the holding angle, the locking mechanism 33 does not prevent the second angle β from changing. Thus, since the second angle β is capable of changing freely when used in the L-shape-mode, excellent operability can be attained. During use in the I-shape-mode shown in FIG. 14, the second angle β equals 90°. When the second angle β is 90°, the locking mechanism 33 does not prevent the first angle α from changing. Thus, since the first angle α is capable of changing freely when used in the I-shape-mode, excellent operability can be attained.

As shown in FIG. 19, a lower surface of the supporting portion 331 is positioned at the same height as the bottom surface 64 of the body 6. According to such a configuration, the following effect is produced. When a force causing the suction pipe 8 to press the joint 7 downward is applied during use, the distal end 62 of the body 6 can be reliably prevented from elevating from the surface to be cleaned due to the lower surface of the supporting portion 331 coming into contact with the surface to be cleaned. As a result, operability can be further improved. The lower surface of the supporting portion 331 need not necessarily be positioned at the same height as the bottom surface 64 of the body 6. A similar effect to that described above is produced by at least partially positioning the supporting portion 331 between the joint 7 and the surface to be cleaned when the body 6 is placed on the surface to be cleaned.

Fourth Embodiment

Figure 21:
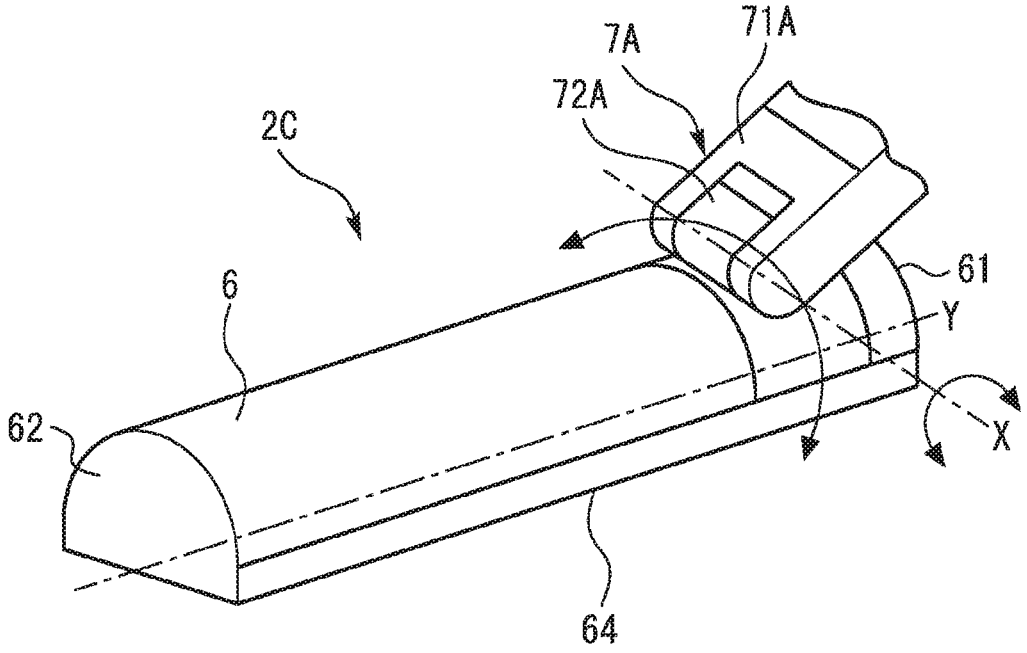
FIG. 21 is a perspective view of a cleaning tool according to a fourth embodiment.
Figure 22:
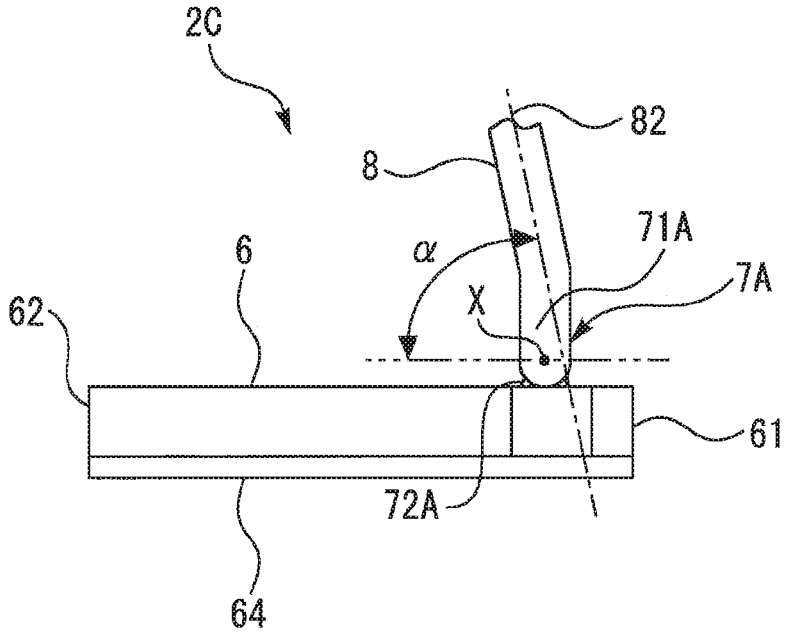
FIG. 22 is a side view of the cleaning tool according to the fourth embodiment as seen from a direction perpendicular to a longitudinal direction of a body.
Figure 23:
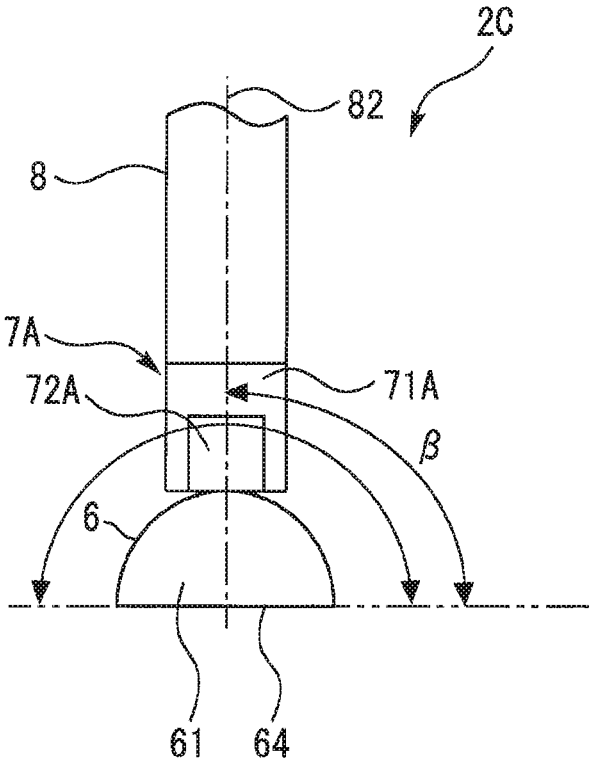
FIG. 23 is a side view of the cleaning tool according to the fourth embodiment as seen from a direction parallel to the longitudinal direction of the body.

Next, while a fourth embodiment will be described with reference to FIGS. 21 to 23, the description will focus on differences from the first embodiment described above and descriptions of same or equivalent portions will be simplified or omitted. FIG. 21 is a perspective view of a cleaning tool 2C according to the fourth embodiment. FIG. 22 is a side view of the cleaning tool 2C according to the fourth embodiment as seen from a direction perpendicular to the longitudinal direction of the body 6. FIG. 23 is a side view of the cleaning tool 2C according to the fourth embodiment as seen from a direction parallel to the longitudinal direction of the body 6.

The cleaning tool 2C according to the fourth embodiment includes a joint 7A in place of the joint 7 according to the first embodiment. As shown in FIG. 22, the joint 7A according to the present embodiment is arranged between the proximal end 61 and the distal end 62 of the body 6 at a position closer to the proximal end 61 than to the distal end 62. As shown in FIG. 21, the joint 7A includes a first rotating portion 71A and a second rotating portion 72A. The second rotating portion 72A is connected to the body 6 so as to be rotatable around the second axis of rotation Y. The first rotating portion 71A is connected to the second rotating portion 72A so as to be rotatable around the first axis of rotation X. In FIG. 21, the first axis of rotation X and the second axis of rotation Y are indicated by long dashed short dashed lines. The second axis of rotation Y is at a skewed position with respect to the first axis of rotation X. In the present embodiment, the second axis of rotation Y is substantially parallel to the longitudinal direction of the body 6. The first axis of rotation X is substantially perpendicular to the second axis of rotation Y. FIGS. 21 to 23 show a state where the second angle $\beta$ is 90°. FIG. 22 shows a state where the first angle $\alpha$ is an acute angle. FIG. 23 shows a state where the first angle $\alpha$ is an obtuse angle.

The cleaning tool 2C according to the present fourth embodiment may include a locking mechanism sharing a same structure as the locking mechanism 26 according to the first embodiment. As in the present fourth embodiment, a joint need not be connected to an end surface of the proximal end 61 of the body 6 in the present invention. In the present invention, the joint need only be positioned closer to the proximal end 61 than to the distal end 62 or, in other words, the joint need only be arranged at a position biased toward the side of the proximal end 61 with respect to the center in the longitudinal direction of the body 6.

With the present fourth embodiment, by rotating the joint 7A, a size of the cleaning tool 2C in the width direction of the body 6 can be selectively changed between a size solely equal to the width of the body 6 and a size obtained by adding the joint 7A to the width of the body 6. Accordingly, cleaning can be carried out by inserting the cleaning tool 2C even into spaces that are as narrow as the width of the body 6. By setting the second angle $\beta$ close to 0° or close to 180°, the size of the cleaning tool 2C in a height direction can be made more or less the same as a height of the body 6. Accordingly, cleaning can be carried out by inserting the cleaning tool 2C even into spaces with a narrow gap in the height direction.

Fifth Embodiment

Figure 24:
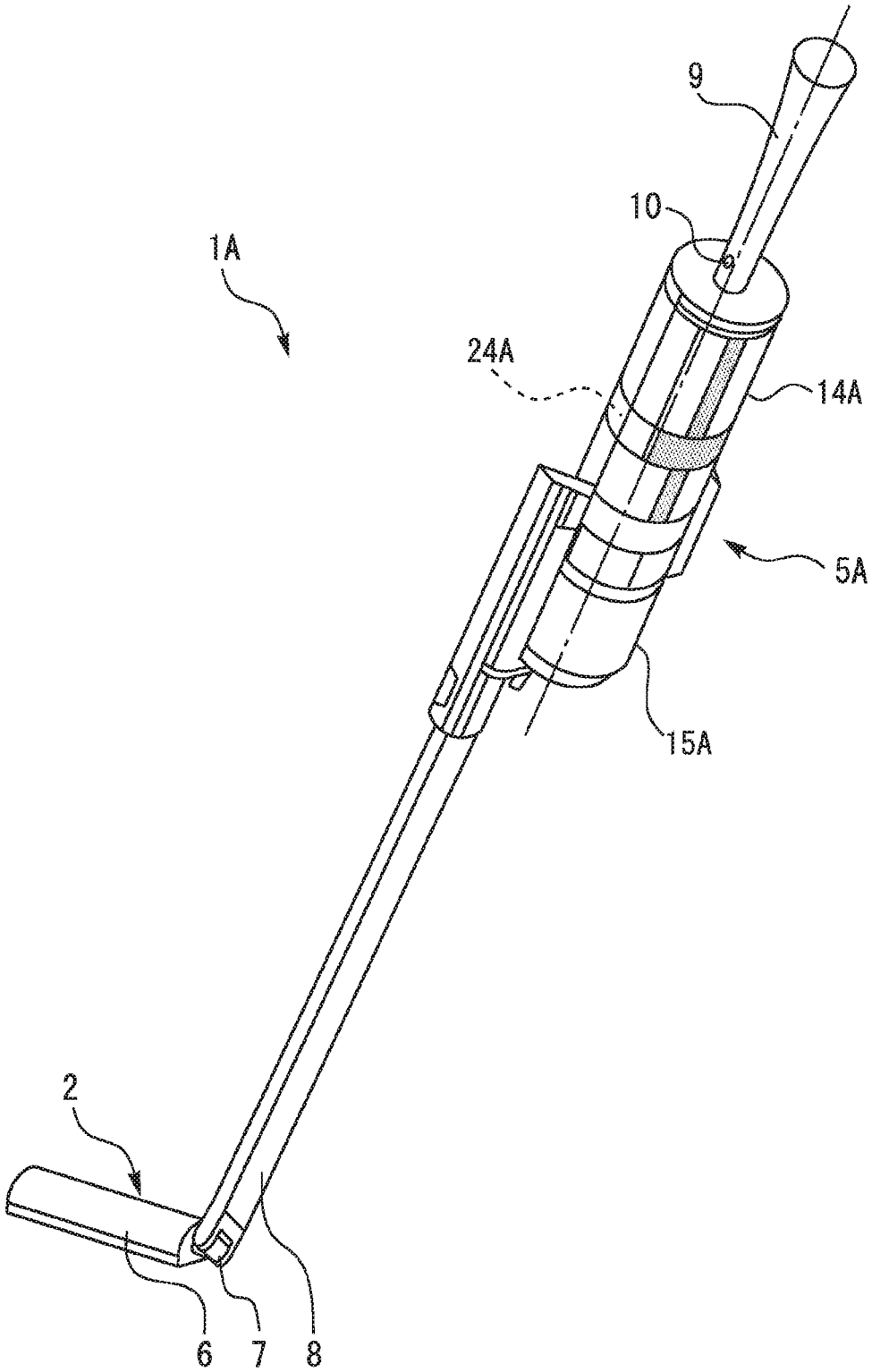
FIG. 24 is a perspective view of a vacuum cleaner according to a fifth embodiment.

Next, while a fifth embodiment will be described with reference to FIG. 24, the description will focus on differences from the embodiments described above and descriptions of same or equivalent portions will be simplified or omitted. FIG. 24 is a perspective view of a vacuum cleaner 1A according to the fifth embodiment. The vacuum cleaner 1A shown in FIG. 24 is, for example, a cordless rechargeable vacuum cleaner. The vacuum cleaner 1A according to the present fifth embodiment includes the cleaning tool 2 and a cleaner main body 5A.

Structures of the body 6, the joint 7, the suction pipe 8, and the locking mechanism 26 of the cleaning tool 2 according to the present fifth embodiment are the same as or similar to those of the cleaning tool 2 according to the first embodiment. The vacuum cleaner 1A according to the present fifth embodiment may include a cleaning tool that is the same as or similar to any of the cleaning tools according to the second to fourth embodiments in place of a cleaning tool that is the same as or similar to the cleaning tool 2 according to the first embodiment.

An external shape of the cleaner main body 5A is a columnar shape. The cleaner main body 5A includes a housing unit 14A and a dust collecting unit 15A. External shapes of the housing unit 14A and the dust collecting unit 15A are columnar shapes. The dust collecting unit 15A is attachably and detachably mounted to a lower side of the housing unit 14A. The handle 9 is coupled to an upper part of the cleaner main body 5A. In FIG. 24, a central axis of the handle 9 and a central axis of the cleaner main body 5A are indicated by a long dashed short dashed line. The central axis of the handle 9 may coincide with the central axis of the cleaner main body 5A. The central axis of the handle 9 may coincide with central axes of the housing unit 14A and the dust collecting unit 15A.

In the present fifth embodiment, the suction pipe 8 of the cleaning tool 2 is connected to the cleaner main body 5A without involving the suction hose 4. The suction pipe 8 is communicated with an inside of the dust collecting unit 15A. A central axis of the suction pipe 8 may be parallel to the central axis of the cleaner main body 5A. When using the vacuum cleaner 1A, the user grips the handle 9 to carry out cleaning while supporting a weight of the cleaner main body 5A. The vacuum cleaner 1A according to the present fifth embodiment includes an electric air blower 24A housed inside the housing unit 14A. A central axis of the electric air blower 24A may coincide with the central axis of the housing unit 14A.

In the fifth embodiment, the handle 9 has a rod-like portion of which a central axis coincides with the central axis of the electric air blower 24A. An overall shape of the handle 9 may be a rod-like shape of which a central axis coincides with the central axis of the electric air blower 24A. According to these configurations, the following effect is produced. A distance between a position gripped by the user and a center of gravity of the cleaner main body 5A is reduced. Accordingly, in particular, a force necessary when twisting the handle 9 may be reduced. As a result, a load applied to a hand of the user when using the vacuum cleaner 1A can be reduced and operability can be further improved.

In the fifth embodiment, the handle 9 is formed so that a cross-sectional area of a distal end part is greater than a cross-sectional area at center in the longitudinal direction. Thus, even if the hand of the user slips from the handle 9 when lifting up the body 6 or the like, the tip portion with a relatively large diameter acts as a stopper. As a result, the handle 9 can be prevented from being dropped from the hand when using the vacuum cleaner 1A, and operability can be further improved.

In the first to fifth embodiments, the body 6 of the cleaning tool may include an agitator (not shown) such as a rotating brush for stirring up dust from a surface to be cleaned by agitating the surface to be cleaned. Driving means which causes the agitator to rotate may be, for example, an electric motor or a turbine that is rotated by an air flow.

In the first to fifth embodiments, the present invention has been described using an example of a cleaning tool for a vacuum cleaner. The cleaning tool according to the present invention is not limited to a cleaning tool for a vacuum cleaner. The cleaning tool according to the present invention can also be applied to, for example, a floor mop. When the cleaning tool according to the present invention is applied to a floor mop, a body of the cleaning tool can hold a fibrous article, a sponge, or the like for cleaning. When the cleaning tool according to the present invention is applied to a cleaning tool other than a vacuum cleaner, a body need not include a suction opening, a wand may be a rod-like member not including a first suction channel, and a joint need not include a second suction channel.

REFERENCE SIGNS LIST

1, 1A Vacuum cleaner
2, 2A, 2B, 2C Cleaning tool
3 Connection pipe
4 Suction hose
5, 5A Cleaner main body
6 Body
7, 7A Joint
8 Suction pipe
9 Handle
10 Operation switch
11 Hose connection port
12 Power cord
13 Wheel
14, 14A Housing unit
15, 15A Dust collecting unit
16 Housing body
17 Housing body
18 First connection port
19 Second connection port
20 Suction air channel-forming portion
21 Suction air channel
22 Exhaust air channel-forming portion
23 Exhaust air channel
24, 24A Electric air blower
25 Lock release button
26 Locking mechanism
27 Releasing mechanism
28 Wire
29 Locking mechanism
31 Upper case
32 Lower case
33 Locking mechanism
61 Proximal end
62 Distal end
63 Suction opening
64 Bottom surface
71, 71A First rotating portion
72, 72A Second rotating portion
81 First suction channel
82 Longitudinal axis
261 First recessed portion
262 Pin
263 Spring
264 Second recessed portion
291 Protruding portion
292 Contact surface
331 Supporting portion
332 Protruding portion
721 Circumferential surface

The invention claimed is:

1. A vacuum cleaner, comprising:

a cleaner main body including an electric air blower for sucking air;

a body including a proximal end, a distal end, and a bottom surface facing a surface to be cleaned during use, a length from the proximal end to the distal end being longer than a width perpendicular to a longitudinal direction from the proximal end toward the distal end;

a rod-like or tube-like wand;

a joint positioned closer to the proximal end than to the distal end, the joint configured to connect the wand to the body so that a first angle can be changed, the first angle being an angle of a longitudinal axis of the wand with respect to the longitudinal direction of the body, the joint including a first rotating portion having a first axis of rotation and a second rotating portion having a second axis of rotation, the second rotating portion being connected to an end portion of the proximal end of the body and the joint being positioned substantially at center in a width direction perpendicular to the longitudinal direction of the body so that the second axis of rotation is substantially parallel to the longitudinal direction of the body, the first rotating portion being rotatably connected to the second rotating portion so as to be rotatable around the first axis of rotation relative to the second rotating portion, and the second axis of rotation being at an intersecting position or a skewed position with respect to the first axis of rotation; and a supporting portion configured to support a downward force of the joint by contact with the surface to be cleaned, the supporting portion being at least partially positioned between the joint and the surface to be cleaned when the body is placed on the surface to be cleaned, wherein the body includes a suction opening in the bottom surface, the suction opening being configured to suck dust, and wherein the joint is rotatable with respect to the body about the first axis of rotation and the second axis of rotation while maintaining an opening direction of the suction opening downward.

2. The vacuum cleaner according to claim 1, wherein the joint is configured to connect the wand to the body so that a second angle can be changed from 0° to 180°, the second angle being an angle between an imaginary plane and the bottom surface of the body, the imaginary plane including an imaginary line parallel to the longitudinal direction of the body and the longitudinal axis of the wand.

3. The vacuum cleaner according to claim 2, further comprising a lock configured to prevent, when the first angle is equal to a holding angle of 90° or less, the first angle from changing from the holding angle to a different angle, wherein the lock is configured not to prevent the second angle from changing at least when the first angle is equal to the holding angle.

4. The vacuum cleaner according to claim 2, further comprising a lock configured to prevent, when the first angle is equal to a holding angle of 90° or less, the first angle from changing from the holding angle to a different angle, wherein the lock is configured to allow the first angle to change from the holding angle to a different angle when the second angle is within an angular range of 90° to 180° but to prevent the first angle from changing from the holding angle to a different angle when the second angle is not within the angular range.

5. The vacuum cleaner according to claim 2, further comprising a lock configured to prevent, when the first angle is equal to a holding angle of 90° or less, the first angle from changing from the holding angle to a different angle, wherein the lock is configured to prevent the first angle and the second angle from changing when the first angle is equal to the holding angle and the second angle is 90°.

6. The vacuum cleaner according to claim 1, further comprising:

a lock configured to prevent, when the first angle is equal to a holding angle of 90° or less, the first angle from changing from the holding angle to a different angle;

a handle; and an operating portion provided on the handle; and a release configured to release a fixation of the first angle by the lock in response to an operation performed on the operating portion.

7. The vacuum cleaner according to claim 1, further comprising a lock configured to prevent, when the first angle is equal to a holding angle of 90° or less, the first angle from changing from the holding angle to a different angle, wherein the lock includes the supporting portion protruding from the body.

8. The vacuum cleaner according to claim 1, wherein the joint includes the first rotating portion configured to be rotatable so as to change the first angle and the second rotating portion configured to be rotatable so as to change a second angle, the second angle being an angle between an imaginary plane and the bottom surface of the body, the imaginary plane including an imaginary line parallel to the longitudinal direction of the body and the longitudinal axis of the wand.

9. The vacuum cleaner according to claim 8, wherein the second rotating portion is connected to the body so as to be rotatable around the second axis of rotation being substantially parallel to the longitudinal direction of the body, and the first rotating portion is connected to the second rotating portion so as to be rotatable around the first axis of rotation being substantially perpendicular to the second axis of rotation.

10. The vacuum cleaner according to claim 1, wherein the wand includes a first suction channel, and the joint includes a second suction channel fluidly connecting to the suction opening and the first suction channel.

11. The vacuum cleaner according to claim 1, further comprising a handle for gripping by a user, wherein a central axis of the handle coincides with a central axis of the wand.

12. The vacuum cleaner according to claim 1, further comprising a handle for gripping by a user, the user gripping the handle to support a weight of the cleaner main body when using the vacuum cleaner, wherein a central axis of the handle is parallel to a central axis of the wand.

* * * * *